US007910820B2

(12) United States Patent
Kobayashi

(10) Patent No.: US 7,910,820 B2
(45) Date of Patent: Mar. 22, 2011

(54) INFORMATION PROCESSING APPARATUS AND METHOD, PROGRAM, AND RECORD MEDIUM

(75) Inventor: Yoshiyuki Kobayashi, Tokyo (JP)

(73) Assignee: Sony Corporation, Tokyo (JP)

( * ) Notice: Subject to any disclaimer, the term of this patent is extended or adjusted under 35 U.S.C. 154(b) by 737 days.

(21) Appl. No.: 11/873,622

(22) Filed: Oct. 17, 2007

(65) Prior Publication Data

US 2008/0097711 A1 Apr. 24, 2008

(30) Foreign Application Priority Data

Oct. 20, 2006 (JP) ..... P2006-286261
Oct. 31, 2006 (JP) ..... P2006-296143

(51) Int. Cl.
*G10H 7/00* (2006.01)

(52) U.S. Cl. ..... 84/616; 700/94

(58) Field of Classification Search ..... 84/602, 84/604, 605, 609, 616; 700/94; 381/56, 381/59

See application file for complete search history.

(56) References Cited

U.S. PATENT DOCUMENTS

| | | | | |
|---|---|---|---|---|
| 7,277,766 | B1 * | 10/2007 | Khan et al. | 700/94 |
| 2004/0043795 | A1 * | 3/2004 | Zancewicz | 455/562.1 |
| 2005/0131688 | A1 | 6/2005 | Goronzy et al. | |
| 2006/0277035 | A1 * | 12/2006 | Hiroe et al. | 704/203 |
| 2007/0095197 | A1 | 5/2007 | Kobayashi et al. | |
| 2007/0282935 | A1 * | 12/2007 | Khan et al. | 708/270 |

FOREIGN PATENT DOCUMENTS

| | | |
|---|---|---|
| EP | 1 531 478 | 5/2005 |
| EP | 1 780 703 | 5/2007 |
| EP | 1 843 323 | 10/2007 |
| GB | 2 358 253 | 11/2000 |
| JP | 06-332492 | 2/1994 |
| JP | 10-285087 | 10/1998 |
| JP | 2000-066691 | 3/2000 |
| JP | 2004-125944 | 4/2004 |
| JP | 2005-195834 | 7/2005 |

OTHER PUBLICATIONS

English-Language translation of Notification of Reasons for Refusal issued Sep. 2, 2008, from the Japanese Patent Office in Japanese Patent Application No. 2006-296143.

Tetsutaro Ono et al., "Mixing sound estimation method using GA for automatic score transcription", Society of Instrument and Control Engineers memoirs, May 31, 1987, vol. 33, No. 5, p. 417-423.

* cited by examiner

*Primary Examiner* — Jeffrey Donels
(74) *Attorney, Agent, or Firm* — Finnegan, Henderson, Farabow, Garrett & Dunner, L.L.P.

(57) ABSTRACT

An information processing apparatus is disclosed. An analyzing section chronologically continuously analyzes sound data which chronologically continue in each of predetermined frequency bands. A continuous characteristic quantity extracting section which extracts a continuous characteristic quantity which is a characteristic quantity which chronologically continues from an analysis result of the analyzing section. A cutting section cuts the continuous characteristic quantity into regions each of which has a predetermined length. A regional characteristic quantity extracting section extracts a regional characteristic quantity which is a characteristic quantity represented by one scalar or vector from each of the regions into which the continuous characteristic quantity has been cut. A target characteristic quantity estimating section estimates a target characteristic quantity which is a characteristic quantity which represents one characteristic of the sound data from each of the regional characteristic quantities.

10 Claims, 25 Drawing Sheets

INFORMATION PROCESSING APPARATUS AND METHOD, PROGRAM, AND RECORD MEDIUM

CROSS REFERENCES TO RELATED APPLICATIONS

The present invention contains subject matter related to Japanese Patent Application JP 2006-286261 filed in the Japanese Patent Office on Oct. 20, 2006, and Japanese Patent Application JP 2006-296143 filed in the Japanese Patent Office on Oct. 31, 2006, the entire contents of which being incorporated herein by reference.

BACKGROUND OF THE INVENTION

1. Field of the Invention

The present invention relates to an information processing apparatus and method, a program, and a record medium, in particular, to those that allow a characteristic of data to be extracted.

2. Description of the Related Art

Techniques of processing information in a predetermined manner and extracting a characteristic quantity that represents a characteristic of the data therefrom are well known. In these techniques, a characteristic quantity that represents a characteristic of a predetermined region of data that chronologically continuous may be extracted.

In a related art reference, during the execution of an information process that uses the result of a sound recognition process, a target executed for the sound recognition process is changed. The settings of the sound recognition environment of the sound recognition process are changed according to the target. Thereafter, the sound recognition process is executed for the changed target according to the changed settings (for example, see Japanese Patent Application Laid-Open No. 2005-195834).

SUMMARY OF THE INVENTION

However, when data are pre-divided into regions and a characteristic of each region is extracted, it would be difficult to consider the influence of the preceding region (or regions) against the current region.

When the resolution of a characteristic quantity to be finally obtained is tried to be increased, it would be necessary to increase the overlap of data to be divided. As a result, the processing quantity would increase in proportion to the resolution.

When data are input in real time, since the process is performed whenever a predetermined quantity of data has been stored, the more complicated an algorithm that extracts a characteristic from the data is, the longer the time lag after data are input until a characteristic quantity is finally obtained would become.

In other words, the time lag (latency) after data are input until a characteristic quantity to be finally obtained is output is obtained by the sum of the time for which data for a region are input and the time for which the data are processed. Thus, the more complicated the algorithm that extracts a characteristic from data is, the longer the time necessary to process the data, namely the longer the time lag (latency) would become.

In addition, when a characteristic is directly extracted from data that represent a continuous quantity, it would be necessary to design a dedicated model and much teacher data used to learn parameters of a characteristic extracting device. In the related art, a general purpose characteristic extracting device was not used. In addition, parameters were not learnt with a small quantity of teacher data.

In view of the foregoing, it would be desirable to provide a technique that allows a characteristic of data to be easily and quickly extracted.

According to an embodiment of the present invention, there is provided an information processing apparatus. The information processing apparatus includes an analyzing section, a continuous characteristic quantity extracting section, a cutting section, a regional characteristic quantity extracting section, and a target characteristic quantity estimating section. The analyzing section chronologically continuously analyzes sound data which chronologically continue in each of predetermined frequency bands. The continuous characteristic quantity extracting section extracts a continuous characteristic quantity which is a characteristic quantity which chronologically continues from an analysis result of the analyzing section. The cutting section cuts the continuous characteristic quantity into regions each of which has a predetermined length. The regional characteristic quantity extracting section extracts a regional characteristic quantity which is a characteristic quantity represented by one scalar or vector from each of the regions into which the continuous characteristic quantity has been cut. The target characteristic quantity estimating section estimates a target characteristic quantity which is a characteristic quantity which represents one characteristic of the sound data from each of the regional characteristic quantities.

The target characteristic quantity estimating section may be pre-created by learning teacher data composed of sound data which chronologically continue and a characteristic quantity which represents one correct characteristic of sound data in each of the regions into which the continuous characteristic quantity has been cut.

The analyzing section may chronologically continuously analyze the sound data which chronologically continue as sounds of musical intervals of 12 equal temperaments of each octave. The continuous characteristic quantity extracting section may extract the continuous characteristic quantity from data which have been obtained as an analysis result of the analyzing section and which represent energies of the musical intervals of the 12 equal temperaments of each octave.

The target characteristic quantity estimating section may estimate the target characteristic quantity which identifies music or talk as a characteristic of the sound data.

The information processing apparatus may also include a smoothening section which smoothens the target characteristic quantities by obtaining a moving average thereof.

The information processing apparatus may also include a storing section which adds a label which identifies a characteristic represented by the estimated target characteristic quantity to the sound data and stores the sound data to which the label has been added.

The information processing apparatus may also include an algorithm creating section which creates an algorithm which extracts the continuous characteristic quantity from the sound data which chronologically continue according to GA (Genetic Algorithm) or GP (Genetic Programming).

According to an embodiment of the present invention, there is provided an information processing method. Sound data which chronologically continue are chronologically continuously analyzed in each of predetermined frequency bands. A continuous characteristic quantity which is a characteristic quantity which chronologically continues is extracted from the analysis result. The continuous characteristic quantity is cut into regions each of which has a predetermined length. A regional characteristic quantity which is a characteristic quantity represented by one scalar or vector is extracted from each of the regions into which the continuous characteristic quantity has been cut. A target characteristic quantity which is a characteristic quantity which represents one characteristic of the sound data is estimated from each of the regional characteristic quantities.

According to an embodiment of the present invention, there is provided a program which is executed by a computer. Sound data which chronologically continue are chronologically continuously analyzed in each of predetermined frequency bands. A continuous characteristic quantity which is a characteristic quantity which chronologically continues is extracted from the analysis result. The continuous characteristic quantity is cut into regions each of which has a predetermined length. A regional characteristic quantity which is a characteristic quantity represented by one scalar or vector is extracted from each of the regions into which the continuous characteristic quantity has been cut. A target characteristic quantity which is a characteristic quantity which represents one characteristic of the sound data is estimated from each of the regional characteristic quantities.

According to an embodiment of the present invention, there is provided a record medium on which a program which is executed by a computer has been recorded. Sound data which chronologically continue are chronologically continuously analyzed in each of predetermined frequency bands. A continuous characteristic quantity which is a characteristic quantity which chronologically continues is extracted from the analysis result. The continuous characteristic quantity is cut into regions each of which has a predetermined length. A regional characteristic quantity which is a characteristic quantity represented by one scalar or vector is extracted from each of the regions into which the continuous characteristic quantity has been cut. A target characteristic quantity which is a characteristic quantity which represents one characteristic of the sound data is estimated from each of the regional characteristic quantities.

According to an embodiment of the present invention, sound data which chronologically continue are chronologically continuously analyzed in each of predetermined frequency bands. The continuous characteristic quantity which is a characteristic quantity which chronologically continues is extracted from the analysis result. The continuous characteristic quantity is cut into regions each of which has a predetermined length. A regional characteristic quantity which is a characteristic quantity represented by one scalar or vector is extracted from each of the regions into which the continuous characteristic quantity has been cut. A target characteristic quantity which is a characteristic quantity which represents one characteristic of the sound data is estimated from each of the regional characteristic quantities.

According to an embodiment of the present invention, a characteristic can be extracted from data.

According to an embodiment of the present invention, a characteristic can be easily and quickly extracted from data.

These and other objects, features and advantages of the present invention will become more apparent in light of the following detailed description of a best mode embodiment thereof, as illustrated in the accompanying drawings.

BRIEF DESCRIPTION OF DRAWINGS

The invention will become more fully understood from the following detailed description, taken in conjunction with the accompanying drawings, wherein similar reference numerals denote similar elements, in which.

DESCRIPTION OF PREFERRED EMBODIMENTS

Next, embodiments of the present invention will be described. The relationship between constituents of the present invention and embodiments described in this specification of the present invention is as follows. The description in this section denotes that embodiments that support the invention set forth in the specification are described in this specification. Thus, even if some embodiments are not described in this section as embodiments corresponding to constituents of the present invention, it is not implied that the embodiments do not correspond to the constituents. Conversely, even if embodiments are described as constituents in this section, it is not implied that these embodiments do not correspond to other than the constituents.

Figure 9:
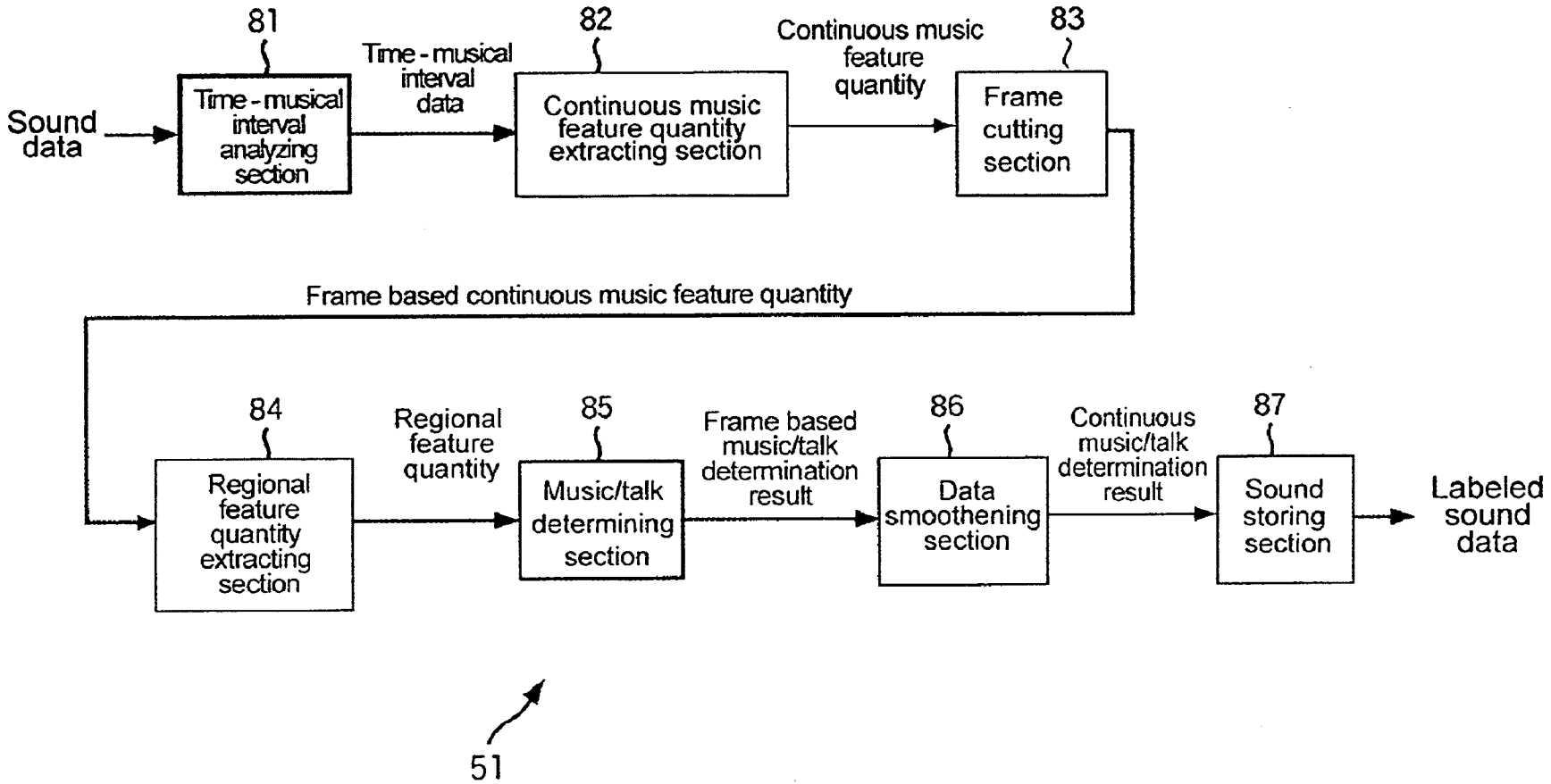
FIG. 9 is a block diagram showing another structure of an information processing apparatus according to an embodiment of the present invention.

According to an embodiment of the present invention, an information processing apparatus includes an analyzing section (for example, an time-musical interval analyzing section 81 shown in FIG. 9), a continuous characteristic quantity extracting section (for example, a continuous music characteristic quantity extracting section 82 shown in FIG. 9), a cutting section (for example, a frame cutting section 83 shown in FIG. 9), a regional characteristic quantity extracting section (for example, a regional characteristic quantity extracting section 84 shown in FIG. 9), and a target characteristic quantity estimating section (for example, a music/talk determining section 85 shown in FIG. 9). The analyzing section chronologically continuously analyzes sound data which chronologically continue in each of predetermined frequency bands. The continuous characteristic quantity extracting section extracts a continuous characteristic quantity which is a characteristic quantity which chronologically continues from an analysis result of the analyzing section. The cutting section cuts the continuous characteristic quantity into regions each of which has a predetermined length. The regional characteristic quantity extracting section extracts a regional characteristic quantity which is a characteristic quantity represented by one scalar or vector from each of the regions into which the continuous characteristic quantity has been cut. The target characteristic quantity estimating section estimates a target characteristic quantity which is a characteristic quantity which represents one characteristic of the sound data from each of the regional characteristic quantities.

The information processing apparatus may also include a smoothening section (for example, a data smoothening section 86 shown in FIG. 9) which smoothens the target characteristic quantities by obtaining a moving average thereof.

The information processing apparatus may also include a storing section (for example, a sound storing section 87 shown in FIG. 9) which adds a label which identifies a characteristic represented by the estimated target characteristic quantity to the sound data and storing the sound data to which the label has been added.

The information processing apparatus may also include an algorithm creating section (for example, a algorithm creating section 101 shown in FIG. 18) which creates an algorithm which extracts the continuous characteristic quantity from the sound data which chronologically continue according to GA (Genetic Algorithm) or GP (Genetic Programming).

Figure 10:
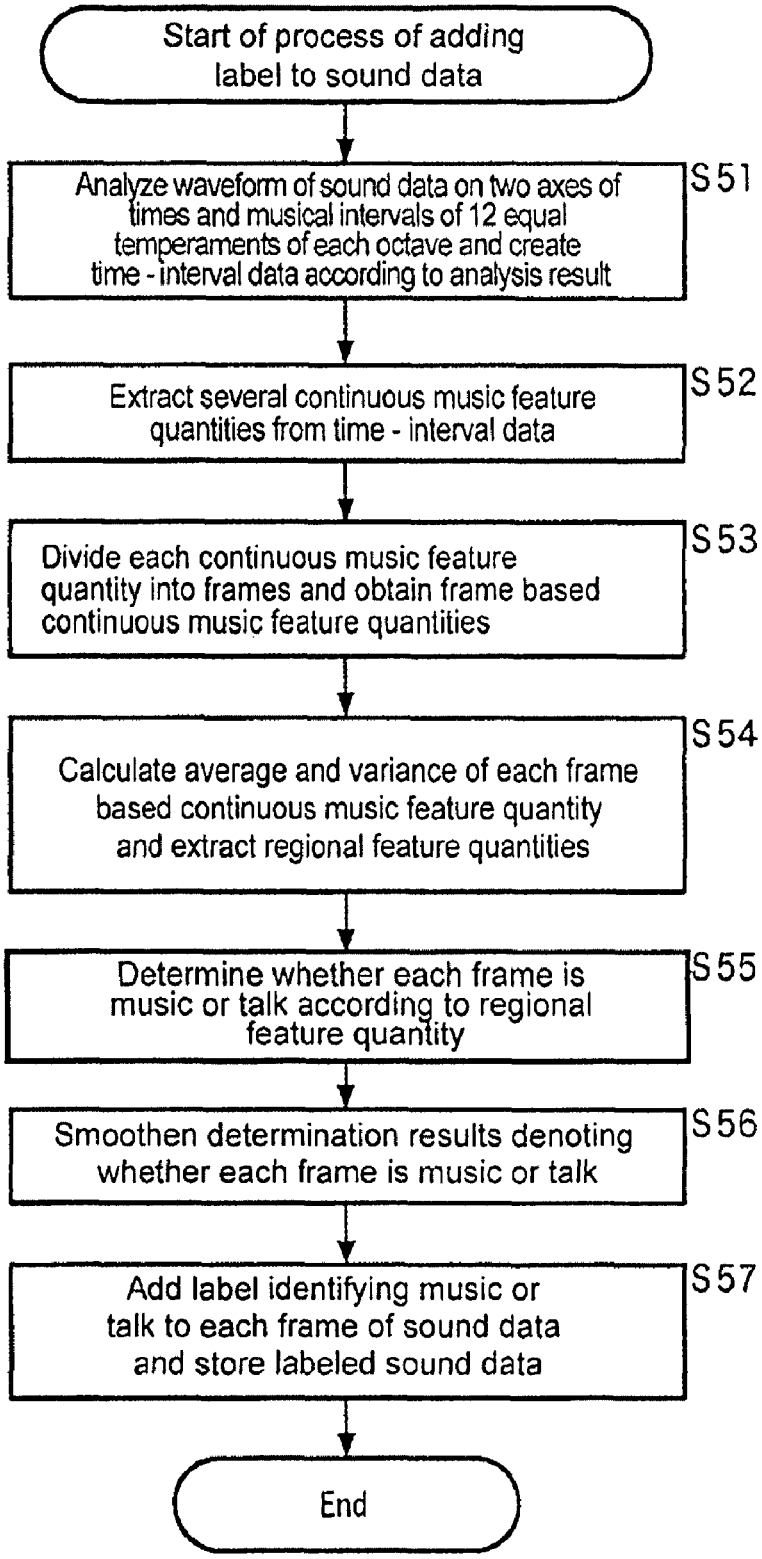
FIG. 10 is a flow chart describing a process of adding a label to sound data.

According to embodiments of the present invention, in an information processing method and a program, sound data which chronologically continue are chronologically continuously analyzed in each of predetermined frequency bands (for example, at step S51 shown in FIG. 10). A continuous characteristic quantity which is a characteristic quantity which chronologically continues is extracted from the analysis result (for example, at step S52 shown in FIG. 10). The continuous characteristic quantity is cut into regions each of which has a predetermined length (for example, at step S53 shown in FIG. 10). A regional characteristic quantity which is a characteristic quantity represented by one scalar or vector is extracted from each of the regions into which the continuous characteristic quantity has been cut (for example, at step S54 shown in FIG. 10). A target characteristic quantity which is a characteristic quantity which represents one characteristic of the sound data is estimated from each of the regional characteristic quantities (for example, at step S55 shown in FIG. 10).

Figure 1:
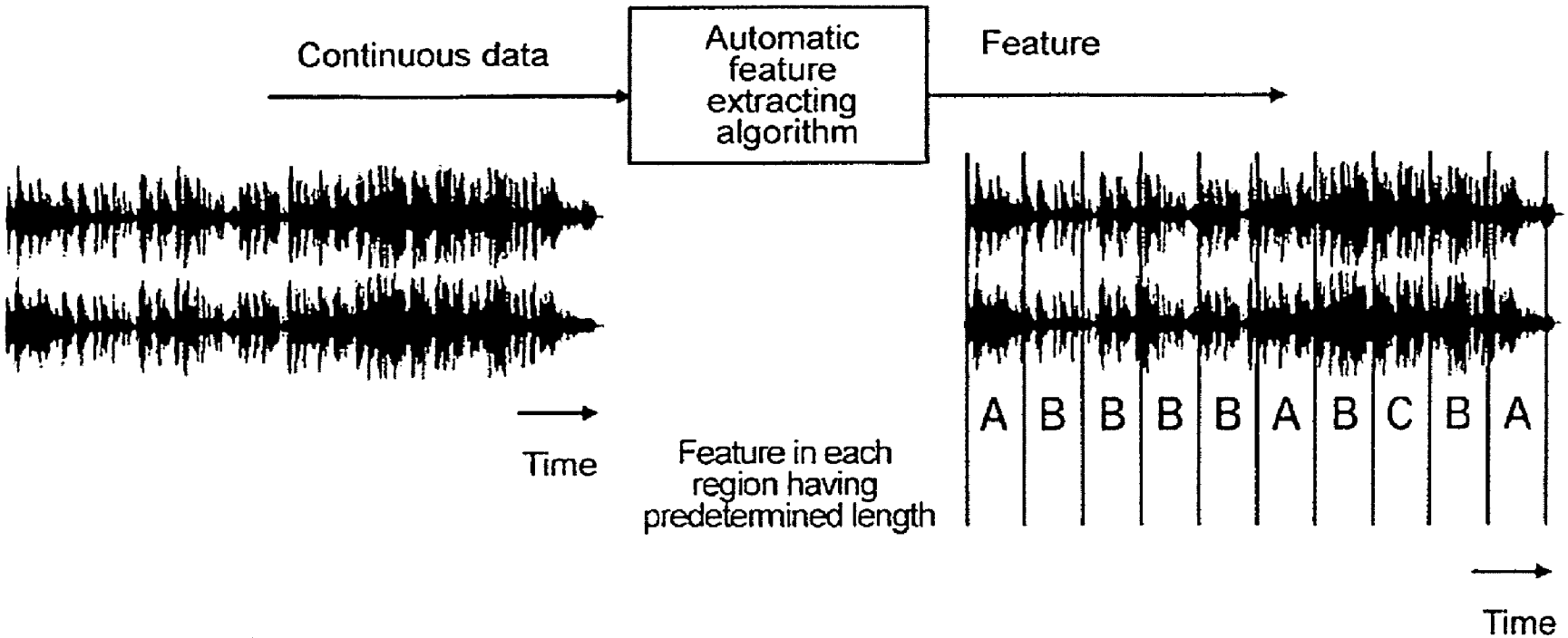
FIG. 1 is a schematic diagram describing that a characteristic is obtained from each portion having a predetermined length of continuous data.

First, as shown in FIG. 1, a technique of applying an automatic characteristic extracting algorithm to continuous data that are chronologically continuous data and obtaining a characteristic at intervals of a predetermined length from the continuous data according to the algorithm will be described. For example, a characteristic that is one of A, B, and C is obtained at intervals of a predetermined length from continuous data that are continuously input as for example waveform data.

Figure 2:
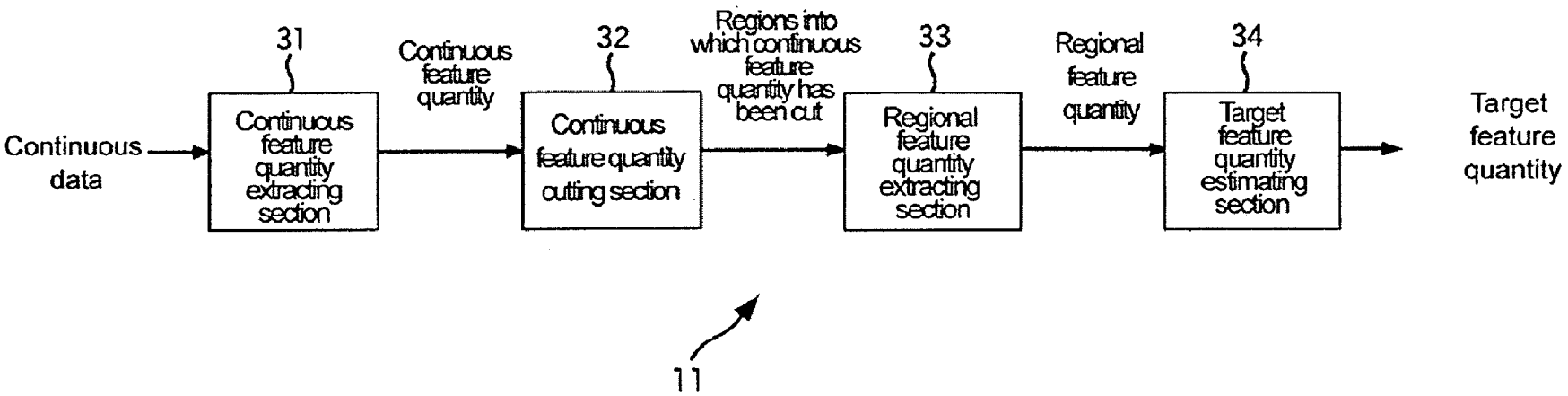
FIG. 2 is a block diagram showing a structure of an information processing apparatus according to an embodiment of the present invention.

FIG. 2 is a block diagram showing a structure of an information processing apparatus 11 according to an embodiment of the present invention. The information processing apparatus 11 extracts a characteristic at intervals of a predetermined length from continuous data. The information processing apparatus 11 is composed of a continuous characteristic quantity extracting section 31, a continuous characteristic cutting section 32, a regional characteristic quantity extracting section 33, and a target characteristic quantity estimating section 34.

The continuous characteristic quantity extracting section 31 obtains continuous data that are chronologically continuous data that are input from the outside and extracts continuous characteristic quantities that are chronological continuous characteristic quantities from the obtained continuous data. The continuous characteristic quantity extracting section 31 extracts at least one continuous characteristic quantities from the continuous data. The continuous characteristic quantity extracting section 31 successively supplies the extracted continuous characteristic quantities to the continuous characteristic cutting section 32.

In other words, continuous characteristic quantities that are characteristic quantities that are chronologically continuous are supplied to the continuous characteristic cutting section 32 in the order of which they have been extracted.

The continuous characteristic cutting section 32 cuts each of the continuous characteristic quantities supplied from the continuous characteristic quantity extracting section 31 into regions each of which has a predetermined length. In other words, the continuous characteristic cutting section 32 creates at least one region of each of the continuous characteristic quantities. The continuous characteristic cutting section 32 successively supplies the regions of each of the continuous characteristic quantities to the regional characteristic quantity extracting section 33 in the order of which they have been cut into the regions.

The regional characteristic quantity extracting section 33 extracts a regional characteristic quantity that is a characteristic quantity represented by one scalar or vector from each of the regions into which each of the continuous characteristic quantities have been cut by the continuous characteristic cutting section 32. In other words, the regional characteristic quantity extracting section 33 extracts at least one regional characteristic quantity from each of the regions of each of the continuous characteristic quantities. The regional characteristic quantity extracting section 33 supplies the extracted regional characteristic quantities to the target characteristic quantity estimating section 34 in the order of which they have been extracted.

The target characteristic quantity estimating section 34 estimates a target characteristic quantity to be finally obtained in each region having a predetermined length. In other words, the target characteristic quantity estimating section 34 estimates a target characteristic quantity that is a characteristic quantity that represents one characteristic of data in each region having the predetermined length from the regional characteristic quantities extracted by the regional characteristic quantity extracting section 33. The target characteristic quantity estimating section 34 outputs the target characteristic quantity that has been estimated by the regional characteristic quantity extracting section 33.

Figure 3:
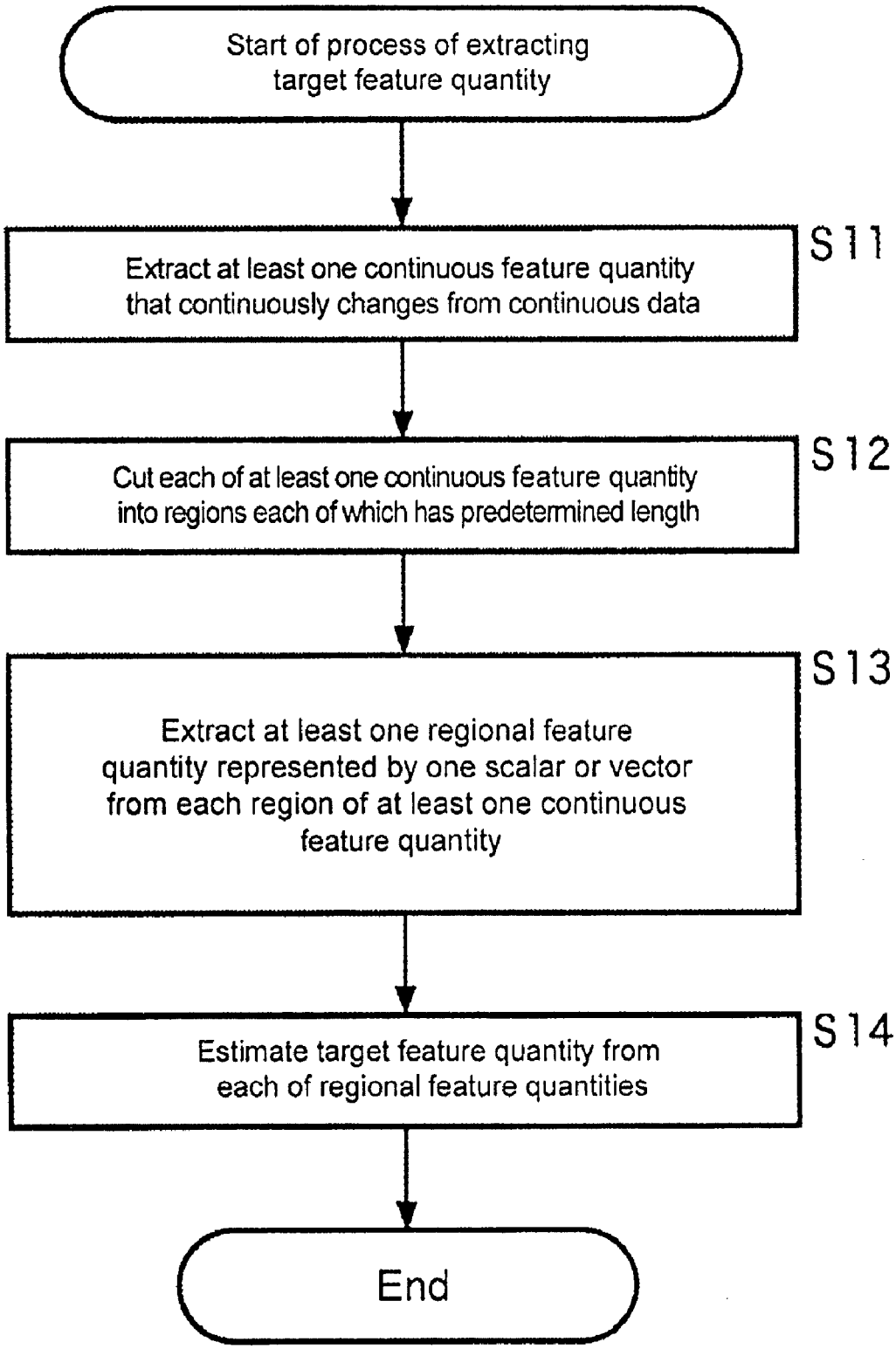
FIG. 3 is a flow chart describing a process of extracting a target characteristic quantity.

Next, with reference to a flow chart shown in FIG. 3, a process of extracting a target characteristic quantity will be described. At step S11, the continuous characteristic quantity extracting section 31 of the information processing apparatus 11 extracts at least one continuous characteristic quantity that continuously changes from continuous data that are chronologically continuous data that have been input from the outside.

Figure 4:
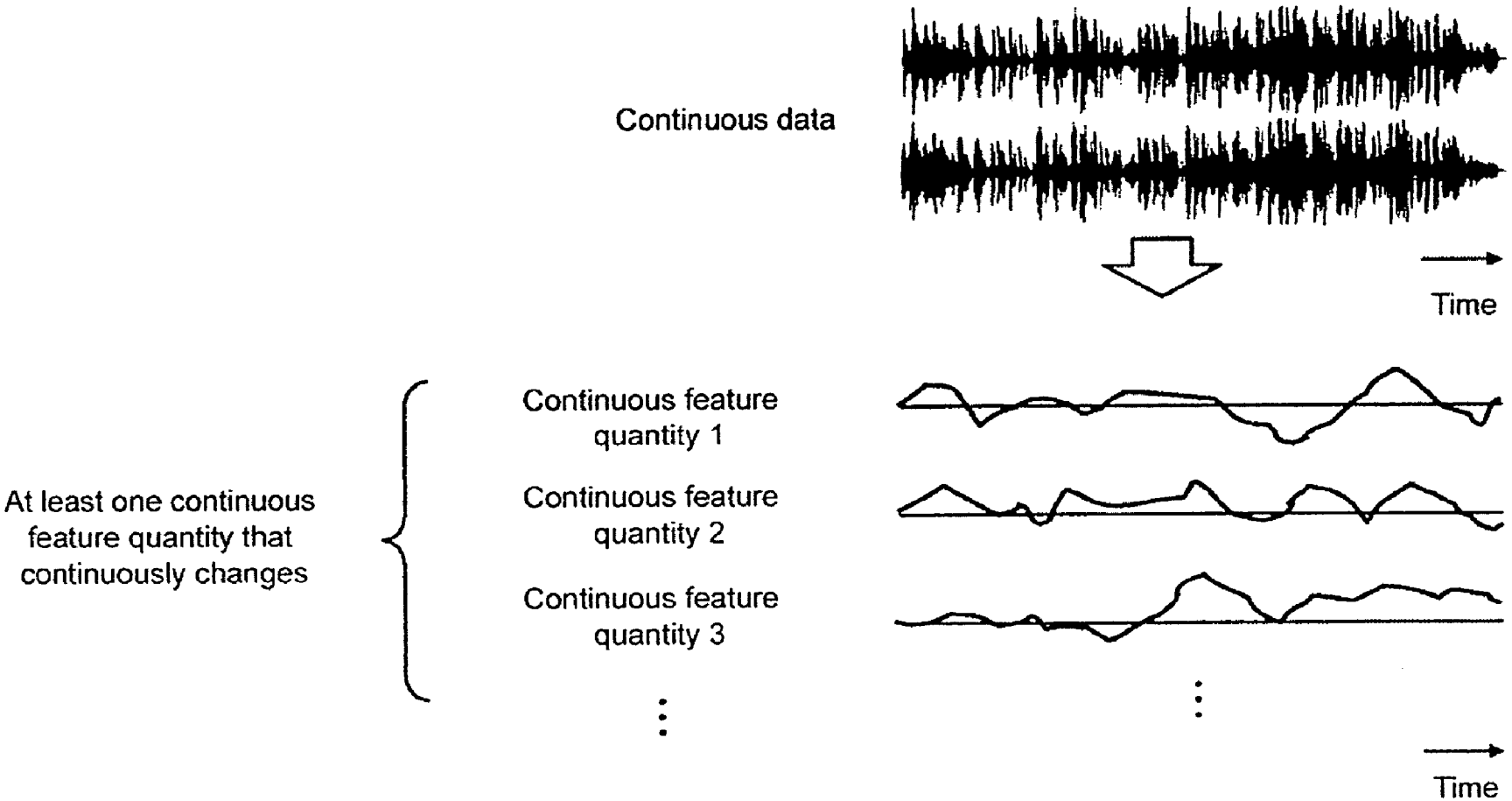
FIG. 4 is a schematic diagram describing that a continuous characteristic quantity is extracted.

For example, as shown in FIG. 4, the continuous characteristic quantity extracting section 31 extracts three continuous characteristic quantities that continuously change such as continuous characteristic quantity 1, continuous characteristic quantity 2, and continuous characteristic quantity 3, from continuous data.

More specifically, when continuous data are sound data, the continuous characteristic quantity extracting section 31 extracts continuous characteristic quantity 1 that represents a sound volume at each time, continuous characteristic quantity 2 that represents a sound of a musical interval of 12 equal temperaments (for example, a sound of Do, Re, or Mi) at each time, and continuous characteristic quantity 3 that represents the balance of a right channel signal and a left channel signal at each time from the continuous data.

When continuous data are moving image data, the continuous characteristic quantity extracting section 31 extracts continuous characteristic quantity 1 that represents the brightness of the moving image at each time, continuous characteristic quantity 2 that represents a moving quantity at each time, and continuous characteristic quantity 3 that represents the color of the moving image at each time from the continuous data.

The continuous characteristic quantity extracting section 31 successively supplies the extracted continuous characteristic quantities to the continuous characteristic cutting section 32 in the order of which they have been extracted.

At step S12, the continuous characteristic cutting section 32 cuts at least one continuous characteristic quantity into regions each of which has a predetermined length.

Figure 5:
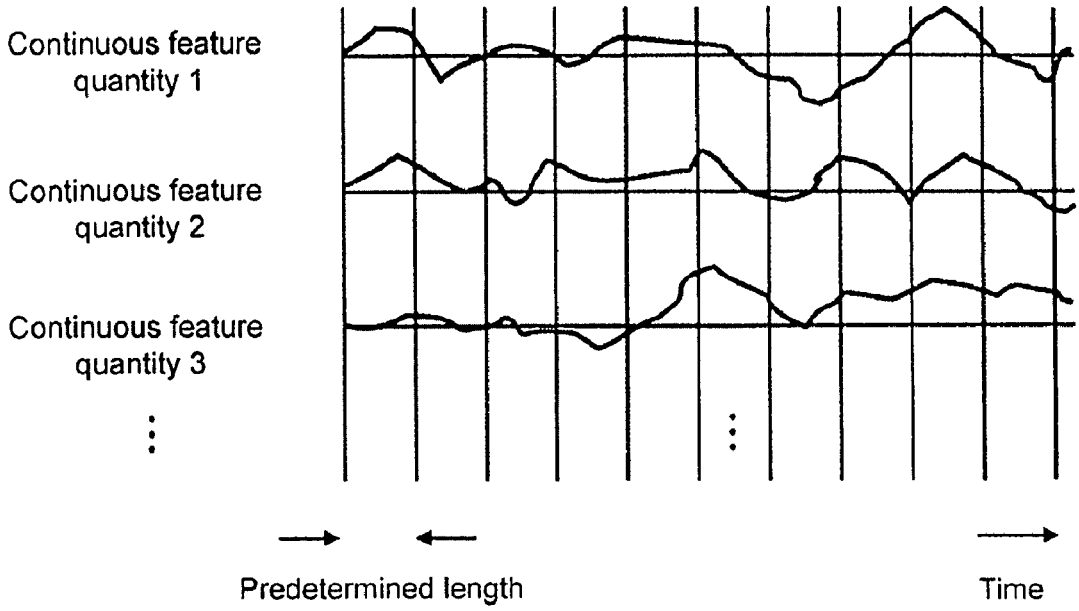
FIG. 5 is a schematic diagram describing that a continuous characteristic quantity is cut.

For example, the continuous characteristic cutting section 32 divides each of continuous characteristic quantities such as continuous characteristic quantity 1, continuous characteristic quantity 2, and continuous characteristic quantity 3, of continuous data into regions each of which has a predetermined length represented by adjacent vertical lines shown in FIG. 5 and cuts each of the continuous characteristic quantities such as continuous characteristic quantity 1, continuous characteristic quantity 2, and continuous characteristic quantity 3 into regions each of which has the predetermined length.

A plurality of continuous characteristic quantities are cut in such a manner that they are cut in the same position and with the same length.

In this example, the length may be based on a time, a data quantity of continuous data, or a predetermined unit (for example, a frame) of continuous data.

The continuous characteristic cutting section 32 may cut each continuous characteristic quantity into regions each of which has a predetermined length such that each cut region overlaps with an adjacent cut region.

More specifically, for example, the continuous characteristic cutting section 32 cuts continuous characteristic quantity 1 that represents a sound volume at each time, continuous characteristic quantity 2 that represents a sound of a musical interval of the 12 equal temperaments at each time, and continuous characteristic quantity 3 that represents the balance of the right channel signal and the left channel signal at each time that have been extracted from continuous data that are sound data into regions each of which has a length of 5 seconds, 10 seconds, or 15 seconds of the sound data.

Instead, for example, the continuous characteristic cutting section 32 cuts continuous characteristic quantity 1 that represents the brightness of the moving image at each time, continuous characteristic quantity 2 that represents the moving quantity at each time, and continuous characteristic quantity 3 that represents the color of the moving image at each time extracted from continuous data that are moving image data into regions each of which has length of 30 frames, 150 frames, or 300 frames of the moving image data.

The continuous characteristic cutting section 32 supplies the regions into which continuous characteristic quantities have been cut to the regional characteristic quantity extracting section 33 in the order of which they have been cut.

At step S13, the regional characteristic quantity extracting section 33 extracts at least one regional characteristic quantity represented by one scalar or vector corresponding to at least one continuous characteristic quantity that has been cut into regions each of which has the predetermined length.

For example, the regional characteristic quantity extracting section 33 applies at least one predetermined process to each of regions into which each of the continuous characteristic quantities have been cut to extract at least one regional characteristic quantity that is a characteristic quantity represented by at least one scalar or vector from each of the continuous characteristic quantities.

One regional characteristic quantity represents a characteristic of one region as one scalar or one vector.

Figure 6:
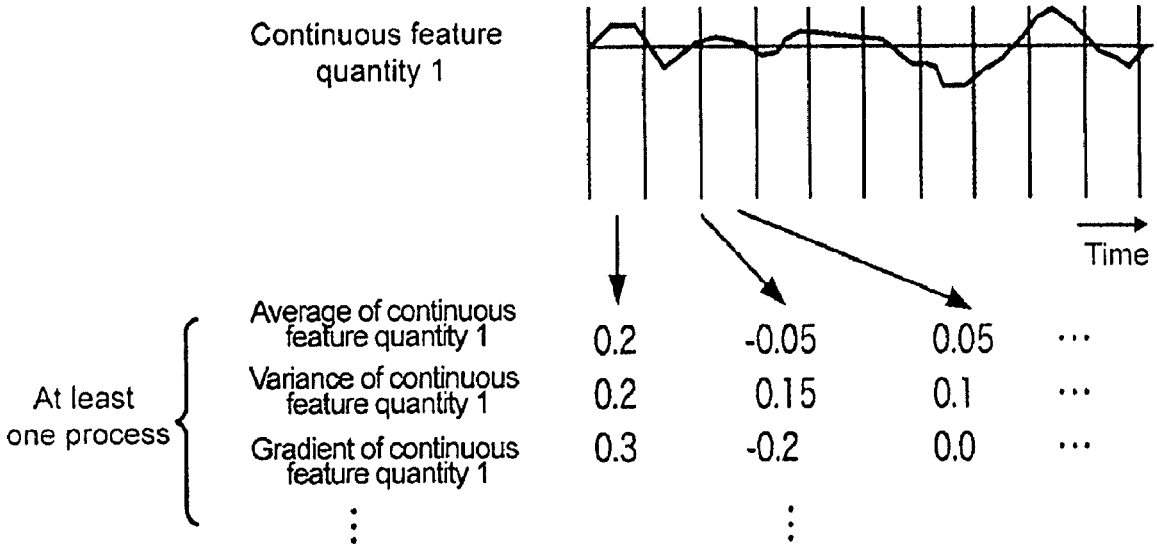
FIG. 6 is a schematic diagram describing that a regional characteristic quantity is extracted.

For example, as shown in FIG. 6, the regional characteristic quantity extracting section 33 obtains the average of continuous characteristic quantity 1 that represents the sound volume at each time of the first region extracted from continuous data that are sound data. Thus, the regional characteristic quantity extracting section 33 extracts 0.2 as a regional characteristic quantity of the first region. Likewise, the regional characteristic quantity extracting section 33 obtains the averages of continuous characteristic quantity 1 that represents the sound volume at each time of the second and third regions extracted from continuous data that are sound data. Thus, the regional characteristic quantity extracting section 33 extracts −0.05 and 0.05 as regional characteristic quantities of the second and third regions, respectively.

In addition, the regional characteristic quantity extracting section 33 obtains the variances of continuous characteristic quantity 1 that represents the sound volume at each time of the first, second, and third regions extracted from continuous data that are sound data. As a result, the regional characteristic quantity extracting section 33 extracts 0.2, 0.15, and 0.1 as regional characteristic quantities of the first, second, and third regions, respectively.

In addition, the regional characteristic quantity extracting section 33 obtains the gradients of continuous characteristic quantity 1 that represents the sound volume at each time of the first, second, and third regions extracted from continuous data that are sound data. Thus, the regional characteristic quantity extracting section 33 extracts 0.3, −0.2, and 0.0 as regional characteristic quantities of the first, second, and third regions, respectively.

Likewise, the regional characteristic quantity extracting section 33 extracts regional characteristic quantities that represent the averages, variances, and gradients of continuous characteristic quantity 1 of the fourth and later regions.

In addition, the regional characteristic quantity extracting section 33 extracts regional characteristic quantities that represent the averages, variances, and gradients of continuous characteristic quantity 2 that represents a sound of a musical interval of the 12 equal temperaments at each time and those of continuous characteristic quantity 3 that represents the balance of the right channel signal and the left channel signal at each time of individual regions extracted from continuous data that is sound data.

When continuous data are moving image data, the regional characteristic quantity extracting section 33 extracts regional characteristic quantities that represent the averages, variances, and gradients of continuous characteristic quantity 1 that represents the brightness of the moving image at each time, continuous characteristic quantity 2 that represents a moving quantity at each time, and continuous characteristic quantity 3 that represents the color of the moving image at each time of individual regions extracted from the continuous data.

At step S14, the target characteristic quantity estimating section 34 estimates a target characteristic quantity of each region from regional characteristic quantities. Thereafter, the process is completed.

Figure 7:
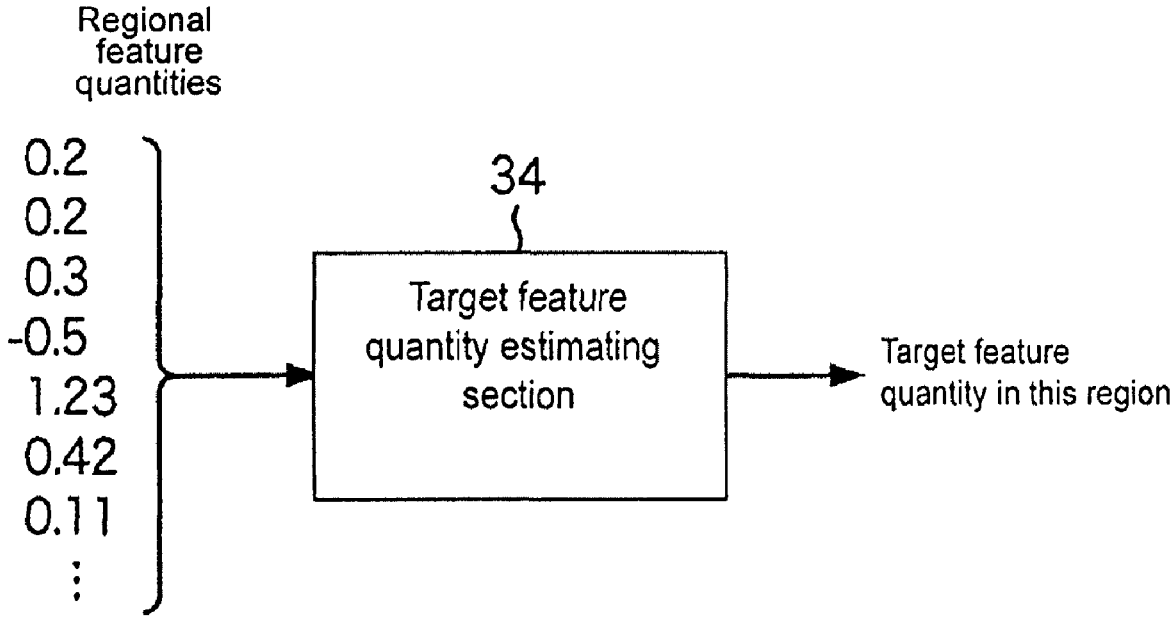
FIG. 7 is a schematic diagram describing that a target characteristic quantity is estimated.

In other words, at step S14, the target characteristic quantity estimating section 34 estimates a target characteristic quantity to be finally extracted from a regional characteristic quantity of each region extracted at step S13. For example, as shown in FIG. 7, when regional characteristic quantities such as regional characteristic quantity 1 to regional characteristic quantity 7 have been extracted, for example 0.2 as regional characteristic quantity 1, 0.2 as regional characteristic quantity 2, 0.3 as regional characteristic quantity 3, −0.5 as regional characteristic quantity 4, 1.23 as regional characteristic quantity 5, 0.42 as regional characteristic quantity 6, and 0.11 as regional characteristic quantity 7 have been extracted, the target characteristic quantity estimating section 34 estimates a target characteristic quantity from regional characteristic quantities 1 to 7.

When continuous data are sound data, target characteristic quantities represent the presence or absence of vocal, the presence or absence of performance of a predetermined instrument, the presence or absence of noise, and so forth.

When continuous data are moving image data, target characteristic quantities represent the presence or absence of a person (or people), the presence or absence of a predetermined subject, the presence or absence of a predetermined motion of the subject (for example, whether or not the subject is dancing), and so forth.

Thus, at step S14, the target characteristic quantity estimating section 34 estimates a target characteristic quantity that is a characteristic quantity that represents one characteristic of data from a regional characteristic quantity in each region.

In other words, the target characteristic quantity estimating section 34 applies a predetermined process to a regional characteristic quantity in each region and estimates a target characteristic quantity in each region.

For example, the target characteristic quantity estimating section 34 is pre-created by learning teacher data composed of a regional characteristic quantity and a target characteristic quantity that represents one correct characteristic of data in each region. In other words, the target characteristic quantity estimating section 34 is pre-created by learning teacher data composed of chronologically continuous data from which a regional characteristic quantity is extracted in each region and a target characteristic quantity that represents one correct characteristic of entire data in each region.

For example, the target characteristic quantity estimating section 34 is created by machine-learning teacher data according to a technique such as regression, classify, SVM (Support Vector Machine), or GP (Genetic Programming).

In such a manner, a characteristic of continuous data in a predetermined region can be extracted.

A continuous characteristic quantity that chronologically continues is extracted from continuous data that chronologically continues. A region having a predetermined length is cut from the continuous characteristic quantity. A regional characteristic quantity that is a characteristic quantity represented by one scalar or vector is extracted from the region of the continuous characteristic quantity that has been cut from the continuous characteristic quantity. A target characteristic quantity that is a characteristic quantity that represents one characteristic of continuous data in each region. Thus, a characteristic of continuous data can be easily and quickly extracted in each region.

Next, more specifically, an embodiment of the present invention will be described.

Figure 8:
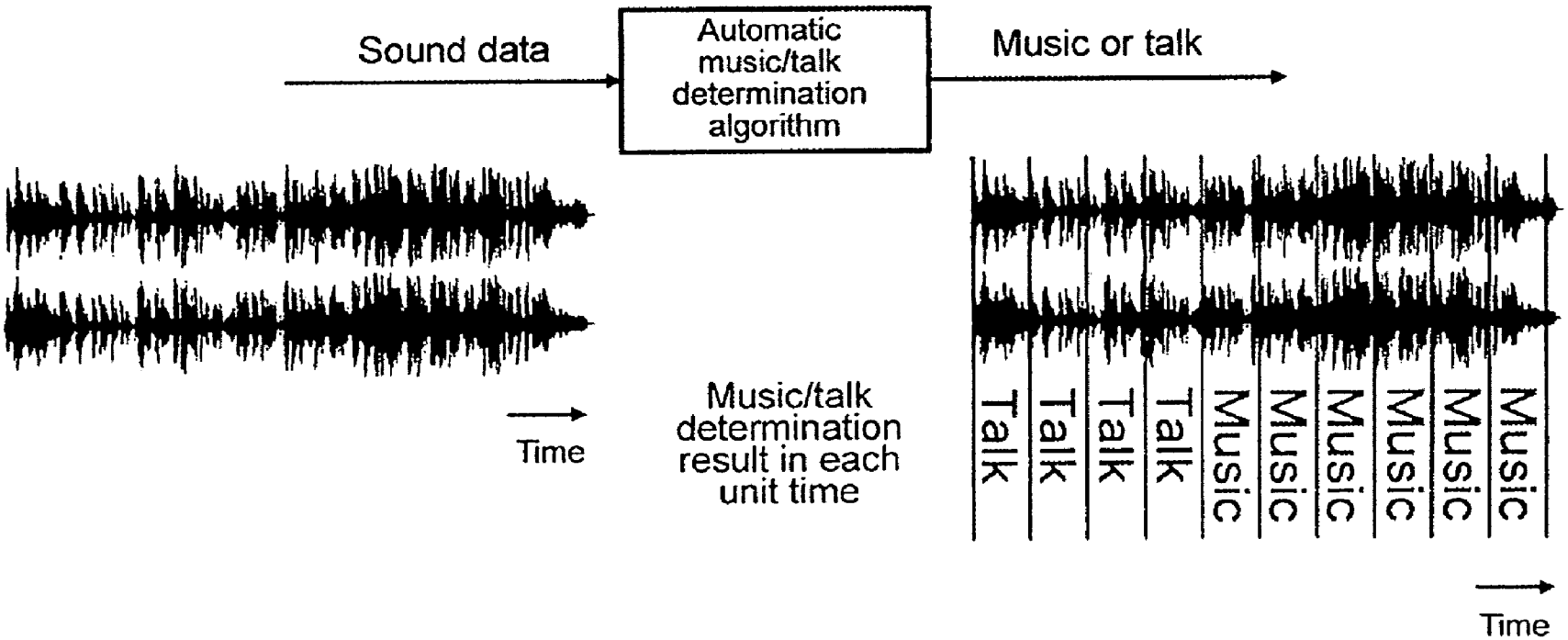
FIG. 8 is a schematic diagram describing that it is determined whether sound data are music or talk at intervals of a unit time.

As shown in FIG. 8, an automatic music/talk determination algorithm is applied to an input of sound data that are chronologically continuous data to determine whether the sound data are music or talk in each unit time and output a determination result of which the sound data are music or talk in each unit time.

For example, a determination result of sound data of waveform data that represents a waveform of a sound is output as talk (T), talk (T), talk (T), talk (T), music (M), music (M), music (M), music (M), music (M), and music (M) at each unit time having a predetermined length of the sound of the sound data.

FIG. 9 is a block diagram showing a structure of an information processing apparatus 51 according to an embodiment of the present invention. The information processing apparatus 51 determines whether input sound data are music or talk at each unit time. The information processing apparatus 51 is composed of a time-musical interval analyzing section 81, a continuous music characteristic quantity extracting section 82, a frame cutting section 83, a regional characteristic quantity extracting section 84, a music/talk determining section 85, a data smoothening section 86, and a sound storing section 87.

The time-musical interval analyzing section 81 chronologically continuously analyzes sound data that chronologically continue in each of predetermined frequency bands. For example, the time-musical interval analyzing section 81 analyzes sound data that chronologically continue on two axes of musical intervals of 12 equal temperaments of each octave and times. The time-musical interval analyzing section 81 obtains time-musical interval data that represent energies of musical intervals of 12 equal temperaments of each octave and that chronologically continue as an analysis result and supplies the time-musical interval data to the continuous music characteristic quantity extracting section 82 in the order of which they have been analyzed. The time-musical interval data that chronologically continue are supplied to the continuous music characteristic quantity extracting section 82 such that they chronologically continue in the order of which they have been analyzed.

The continuous music characteristic quantity extracting section 82 extracts a continuous music characteristic quantity that is a chronologically continuous characteristic quantity from the time-musical interval data that are chronologically continuous data supplied from the time-musical interval analyzing section 81. The continuous music characteristic quantity extracting section 82 supplies the extracted continuous music characteristic quantity to the frame cutting section 83 in the order of which it has been extracted. The continuous music characteristic quantity that is a chronologically continuous characteristic quantity is supplied to the frame cutting section 83 such that they chronologically continue in the order of which they have been extracted.

The frame cutting section 83 cuts the continuous music characteristic quantity supplied from the continuous music characteristic quantity extracting section 82 into frames each of which has a predetermined length. The frame cutting section 83 supplies the continuous music characteristic quantity that has been cut into frames as a frame based continuous music characteristic quantity to the regional characteristic quantity extracting section 84 in the order of which it has been cut into frames.

The regional characteristic quantity extracting section 84 extracts a regional characteristic quantity that is a characteristic quantity represented by one scalar or vector in each frame from the frame based continuous music characteristic quantity. The regional characteristic quantity extracting section 84 supplies the extracted regional characteristic quantities to the music/talk determining section 85 in the order of which they have been extracted.

The music/talk determining section 85 estimates a target characteristic quantity that is a characteristic of each frame of sound data and that represents a characteristic that identifies music or talk from each of the regional characteristic quantities extracted by the regional characteristic quantity extracting section 84. In other words, the music/talk determining section 85 estimates a target characteristic quantity that identifies music or talk as one characteristic of sound data in each frame.

The music/talk determining section 85 supplies a frame based music/talk determination result that represents a characteristic of each frame that identifies music or talk obtained as the estimation result to the data smoothening section 86.

The data smoothening section 86 obtains the moving average of the frame based music/talk determination result supplied from the music/talk determining section 85 and smoothens the target characteristic quantity according to the obtained moving average. The data smoothening section 86 obtains a continuous music/talk determination result as the smoothening result and supplies the continuous music/talk determination result to the sound storing section 87.

The sound storing section 87 creates a label that identifies music or talk according to the continuous music/talk determination result supplied from the data smoothening section 86 and adds the created label to the sound data. The sound storing section 87 stores labeled sound data to for example a record medium (not shown).

In other words, the sound storing section 87 adds a label that represents an estimated target characteristic quantity to sound data and stores the resultant labeled sound data.

The sound storing section 87 may store labeled sound data in such a manner that the sound storing section 87 records them to a server (not shown) connected to the information processing apparatus 11 though a network.

FIG. 10 is a flow chart describing a process of adding a label to sound data. At step S51, the time-musical interval analyzing section 81 analyzes a waveform of sound data that chronologically continue on two axes of times and musical intervals of 12 equal temperaments of each octave and creates time-musical interval data according to the analysis result.

Figure 11:
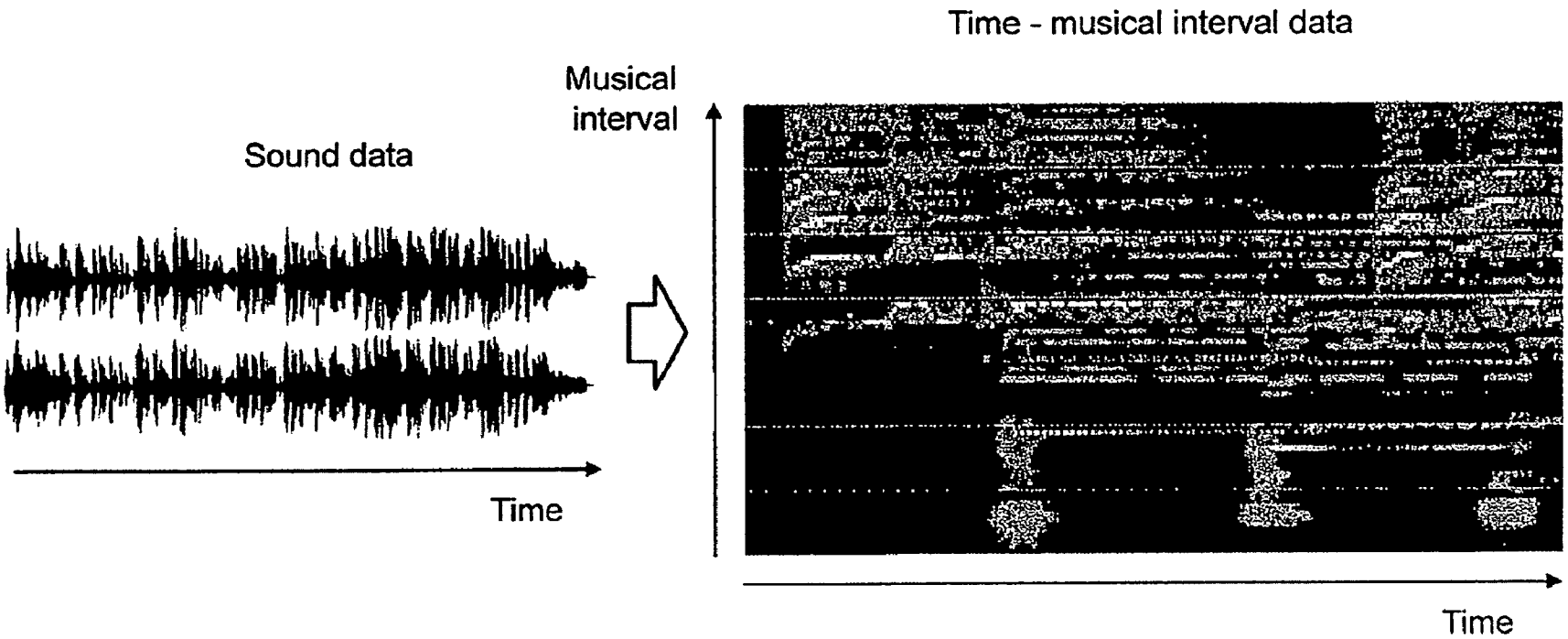
FIG. 11 is a schematic diagram describing time-musical interval data.

For example, as shown in FIG. 11, at step S51, the time-musical interval analyzing section 81 divides sound data into components of a plurality of octaves and obtains energies of musical levels of 12 equal temperaments of each octave, analyzes the sound data on two axes of times and musical intervals of 12 equal temperaments of each octave, and creates time-musical interval data according to the analysis result.

More specifically, when sound data are stereo data, the time-musical interval analyzing section 81 obtains energies of musical intervals of 12 equal temperaments of each of a plurality of octaves of each of right channel data and left channel data of the sound data and adds the energy obtained from the left channel data and the energy obtained from the right channel data of each octave to create time-musical interval data.

The time musical interval analyzing section 81 creates time-musical interval data that are chronologically continuous data. The time-musical interval analyzing section 81 supplies the created time-musical interval data to the continuous music characteristic quantity extracting section 82 in the order of which they have been created.

At step S52, the continuous music characteristic quantity extracting section 82 extracts several continuous music characteristic quantities from the time-musical interval data.

Figure 12:
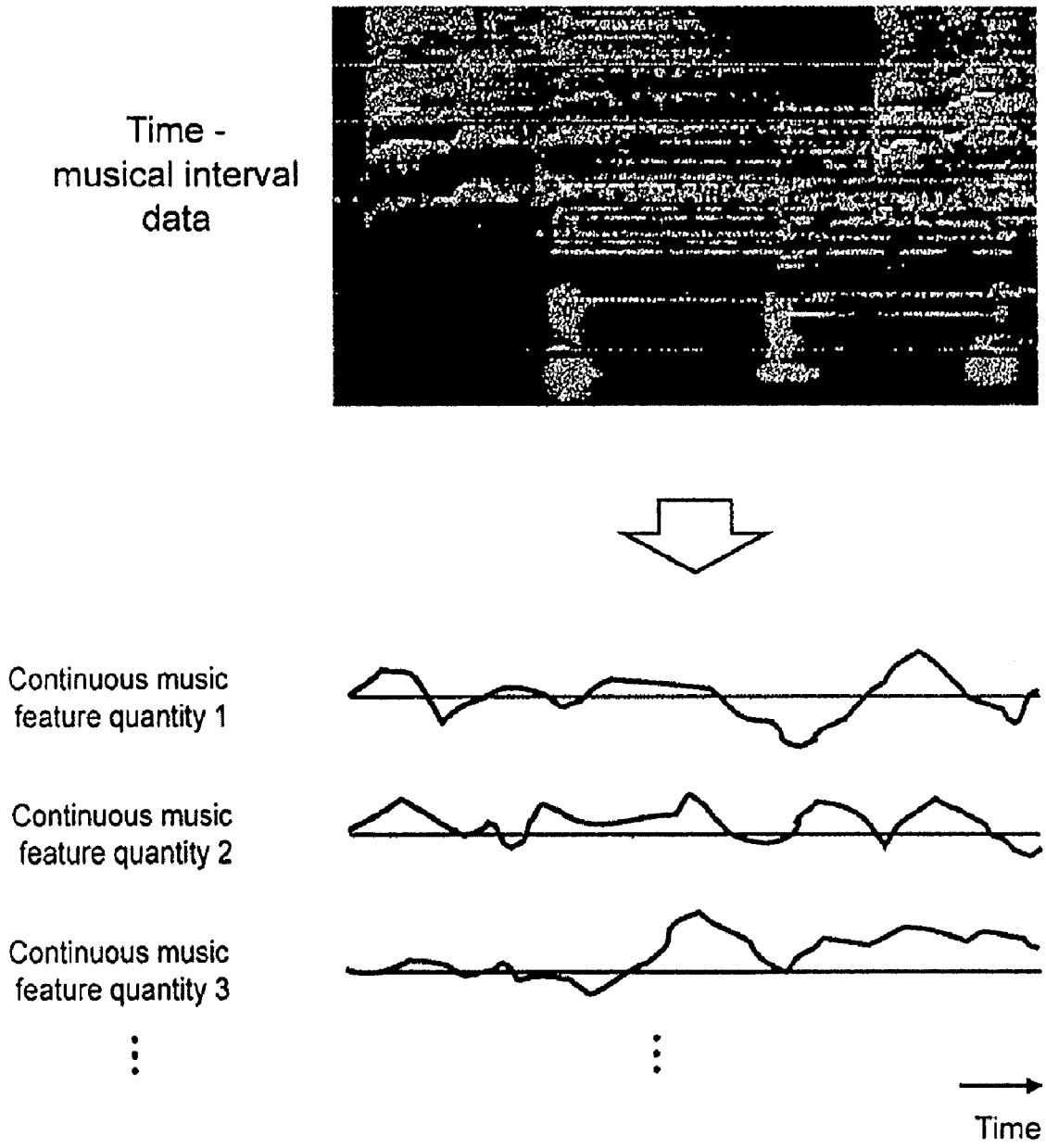
FIG. 12 is a schematic diagram describing that a continuous music characteristic quantity is extracted from time-musical interval data.

For example, at step S52, the continuous music characteristic quantity extracting section 82 extracts continuous music characteristic quantities that chronologically change such as continuous music characteristic quantity 1, continuous music characteristic quantity 2, and continuous music characteristic quantity 3 from the time-musical interval data that represent energies of musical intervals of 12 equal temperaments of each octave. For example, as shown in FIG. 12, the continuous music characteristic quantity extracting section 82 extracts continuous music characteristic quantity 1 that represents the level ratio of musical ranges at each time, continuous music characteristic quantity 2 that represents the energy difference or level difference of the right channel and the left channel at each time, and continuous music characteristic quantity 3 that represents parameters of envelops such as attack, decay, sustain, release, and so forth from the time-musical interval data that represent energies of musical intervals of 12 equal temperaments of each octave. Instead, for example, the continuous music characteristic quantity extracting section 82 extracts continuous music characteristic quantity 1 that represents the ratio of rhythms at each time, continuous music characteristic quantity 2 that represents the number of sounds at each time, and continuous music characteristic quantity 3 that represents a structure of harmonics at each time from the time-musical interval data that represent energies of musical intervals of 12 equal temperaments of each octave.

In addition, the continuous music characteristic quantity extracting section 82 may extract a continuous music characteristic quantity that represents a sound density, variation of musical intervals, or the like from the time-musical interval data that represent energies of musical intervals of 12 equal temperaments of each octave.

The continuous music characteristic quantity extracting section 82 supplies the extracted continuous music characteristic quantities to the frame cutting section 83 in the order of which they have been extracted.

At step S53, the frame cutting section 83 divides each of the continuous music characteristic quantities into frames and obtains frame based continuous music characteristic quantities.

Figure 13:
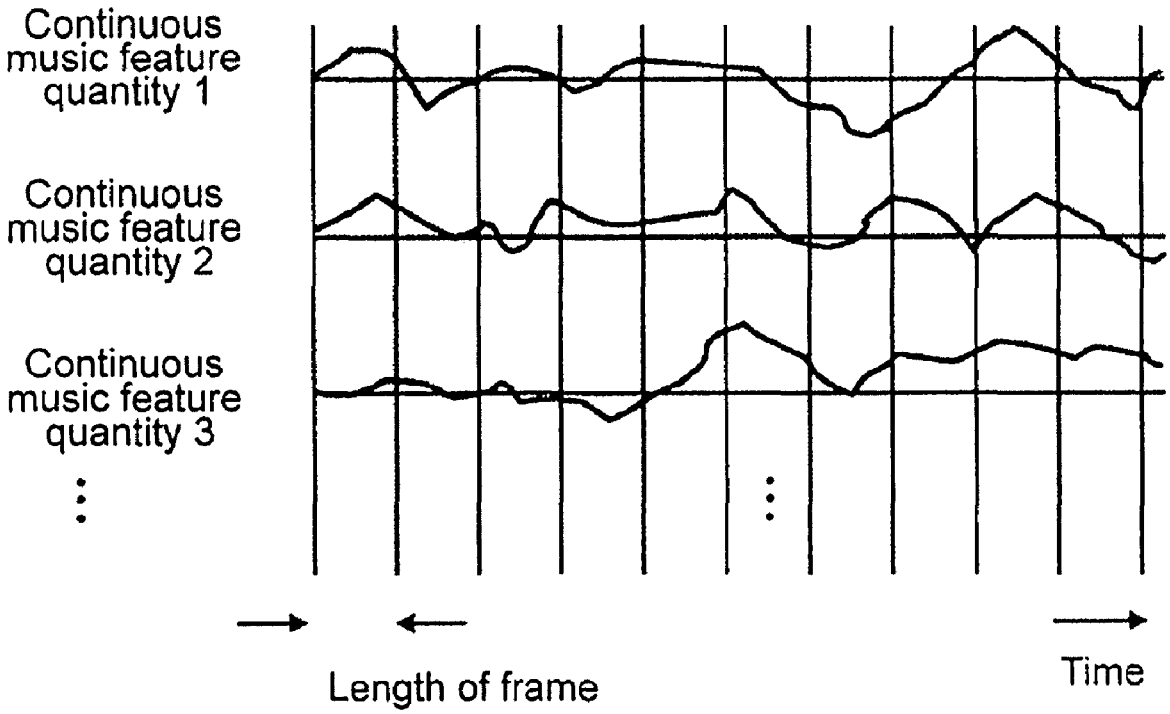
FIG. 13 is a schematic diagram describing that a continuous music characteristic quantity is cut.

For example, as shown in FIG. 13, the frame cutting section 83 divides each of continuous music characteristic quantities such as continuous music characteristic quantity 1, continuous music characteristic quantity 2, and continuous music characteristic quantity 3 into frames. In this example, a frame is a period between a time represented by a vertical line shown in FIG. 13 and a time represented by a vertical line adjacent thereto. A frame is a period having a predetermined length.

The frame cutting section 83 cuts continuous music characteristic quantities such as continuous music characteristic quantity 1, continuous music characteristic quantity 2, and continuous music characteristic quantity 3 into frames.

The frame cutting section 83 cuts a plurality of continuous music characteristic quantities into frames such that they are cut at the same position and with the same length.

The frame cutting section 83 supplies frame based continuous music characteristic quantities divided into frames to the regional characteristic quantity extracting section 84 in the order of which they have been divided.

At step S54, the regional characteristic quantity extracting section 84 calculates the average and variance of frame based continuous music characteristic quantities divided to extract a regional characteristic quantity in each frame.

The regional characteristic quantity extracting section 84 applies at least one predetermined process to each of frame based continuous music characteristic quantities and extracts a regional feature quantity that is a characteristic quantity represented by at least one scalar or vector from each of the frame based continuous music characteristic quantities.

Figure 14:
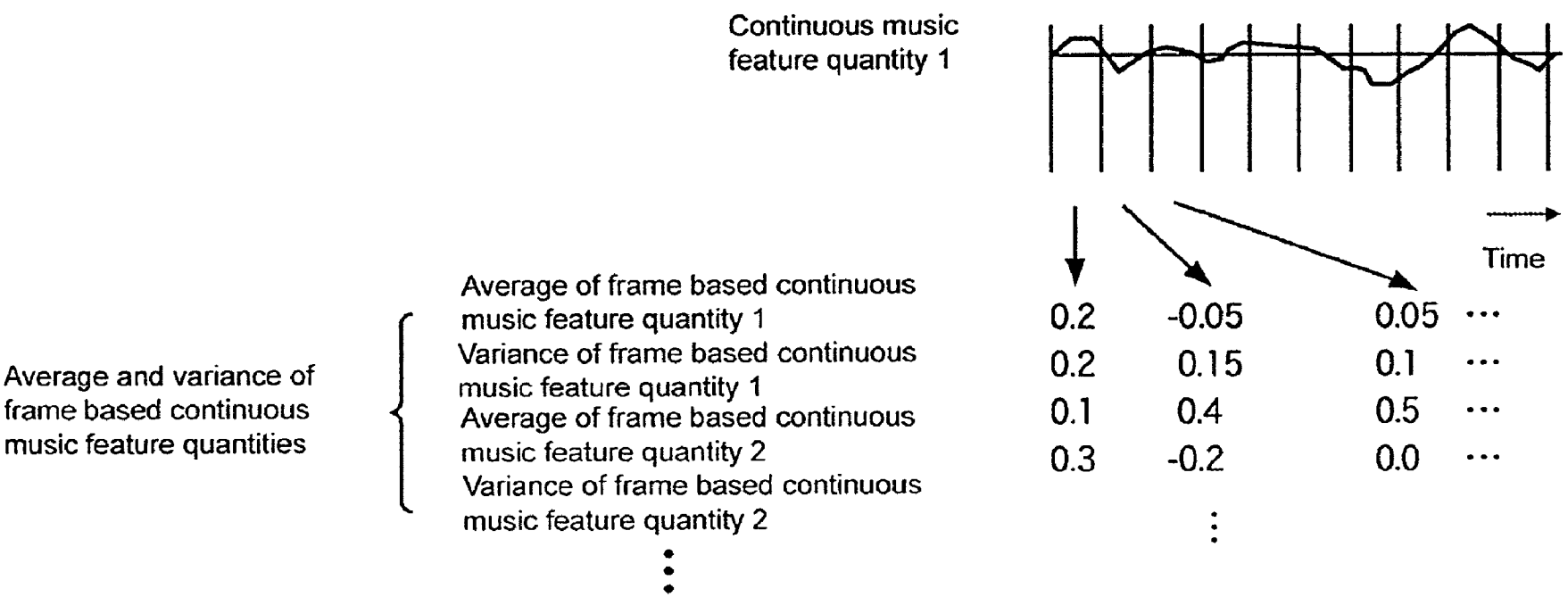
FIG. 14 is a schematic diagram describing that a regional characteristic quantity is extracted.

For example, as shown in FIG. 14, the regional characteristic quantity extracting section 84 obtains the average of the first frame of frame based continuous music characteristic quantity 1 that represents the level ratio of each musical range at each time. Thus, the regional characteristic quantity extracting section 84 extracts 0.2 as a regional characteristic quantity of the first frame. Likewise, the regional characteristic quantity extracting section 84 obtains the averages of the second and third frames of frame based continuous music characteristic quantity 1 that represents the level ratio of each musical range at each time. Thus, the regional characteristic quantity extracting section 84 extracts −0.05 and 0.05 as regional characteristic quantities of the second and third frames, respectively.

In addition, the regional characteristic quantity extracting section 84 obtains the variances of the first, second, and third frames of frame based continuous music characteristic quantity 1 that represents the level ratio of each musical range at each time. Thus, the regional characteristic quantity extracting section 84 extract 0.2, 0.15, and 0.1 as regional characteristic quantities of the first, second, and third frames, respectively.

The regional characteristic quantity extracting section 84 extracts regional characteristic quantities that represent the averages or variances of the fourth and later frames of frame based continuous music characteristic quantity 1.

In addition, for example, as shown in FIG. 14, the regional characteristic quantity extracting section 84 obtains the average of the first frame of frame based continuous music characteristic quantity that represents the energy difference or level difference of the right channel and the left channel at each time. Thus, the regional characteristic quantity extracting section 84 obtains 0.1 as a regional characteristic quantity of the first frame. Likewise, the regional characteristic quantity extracting section 84 obtains the averages of the second and third frames of frame based continuous music characteristic quantity 2. Thus, the regional characteristic quantity extracting section 84 extracts 0.4 and 0.5 as regional characteristic quantities of the second and third frames, respectively.

In addition, the regional characteristic quantity extracting section 84 obtains the variances of the first, second, and third frames of frame based continuous music characteristic quantity 2 that represents the energy difference or level difference of the right channel and the left channel at each time. Thus, the regional characteristic quantity extracting section 84 extracts 0.3, −0.2, and 0.0 as regional characteristic quantities of the first, second, and third frames, respectively.

Likewise, the regional characteristic quantity extracting section 84 extracts regional characteristic quantities that represent the averages or variances of the fourth frame and later frames of frame based continuous music characteristic quantity 2.

The regional characteristic quantity extracting section 84 extracts regional characteristic quantities from frames of frame based continuous music characteristic quantity 3.

The regional characteristic quantity extracting section 84 supplies the extracted regional characteristic quantities to the music/talk determining section 85.

At step S55, the music/talk determining section 85 determines whether each frame is music or talk according to the regional characteristic quantities.

For example, the music/talk determining section 85 applies a relatively simple operation (for example, four-rule arithmetic operations, an exponentiation operation, or the like) represented by a pre-created target characteristic quantity extraction formula to at least one regional characteristic quantity of those that have been input and obtains a frame based music/talk determination result that is a target characteristic quantity that represents a probability of music as an operation result. The music/talk determining section 85 pre-stores the target characteristic quantity extraction formula.

When a target characteristic quantity represents a probability of music and the target characteristic quantity of a predetermined region is 0.5 or larger, the music/talk determining section 85 outputs a frame based music/talk determination result that denotes that the frame is music. When a target characteristic quantity represents a probability of music and the target characteristic quantity of a predetermined region is smaller than 0.5, the music/talk determining section 85 outputs a frame based music/talk determination result that denotes that the frame is talk.

Figure 15:
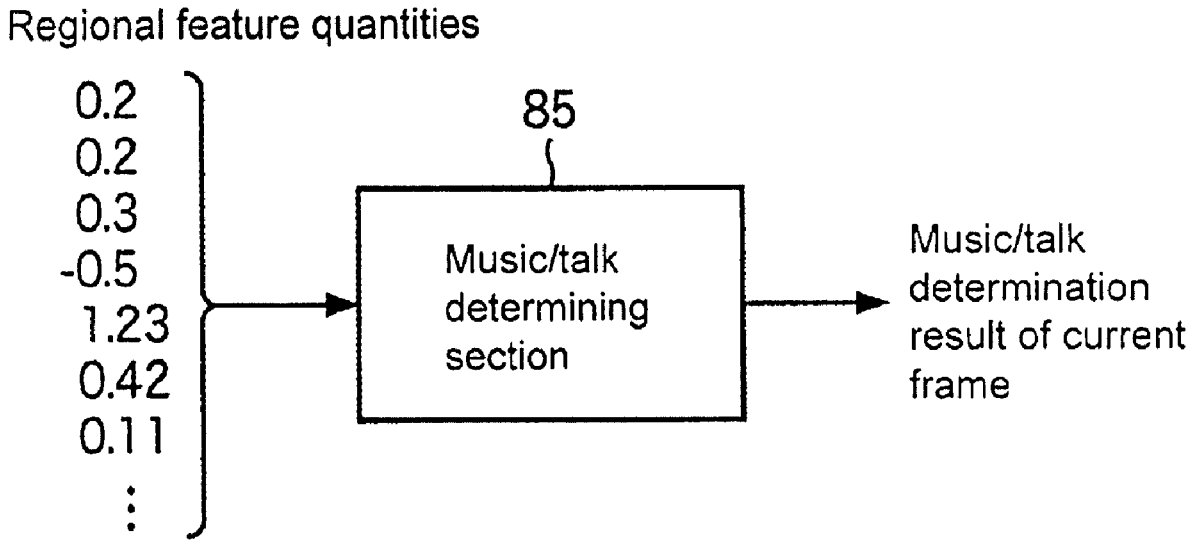
FIG. 15 is a schematic diagram describing that it is determined whether a frame is music or talk.

For example, as shown in FIG. 15, when regional characteristic quantities such as regional characteristic quantity 1 to regional characteristic quantity 7 have been extracted in each frame, the music/talk determining section 85 determines whether this frame is music or talk according to 0.2 as regional characteristic quantity 1, 0.2 as regional characteristic quantity 2, 0.3 as regional characteristic quantity 3, −0.5 as regional characteristic quantity 4, 1.23 as regional characteristic quantity 5, 0.42 as regional characteristic quantity 6, and 0.11 as regional characteristic quantity 7.

For example, the music/talk determining section 85 is pre-created by learning teacher data composed of a regional characteristic quantity in each frame and a target characteristic quantity that correctly represents whether each frame is music or talk. In other words, the music/talk determining section 85 is pre-created by learning a target characteristic quantity extraction formula using teacher data composed of chronologically continuous sound data from which a regional characteristic quantity is extracted in each frame and a target characteristic quantity that correctly denotes whether each frame is music or talk.

A target characteristic quantity extraction formula pre-stored in the music/talk determining section 85 is pre-created by genetically learning teacher data composed of chronologically continuous sound data and a target characteristic quantity that correctly denotes whether each frame is music or talk.

Examples of a learning algorithm that creates a target characteristic quantity extraction formula include regression, classify, SVM (Support Vector Machine), and GP (Genetic Programming).

The music/talk determining section 85 supplies a frame based music/talk determination result that represents a determination result of whether each frame is music or talk to the data smoothening section 86.

At step S56, the data smoothening section 86 smoothens the determination result of whether each frame is music or talk.

For example, the data smoothening section 86 filters the determination result of whether each frame is music or talk to smoothen the determination result. More specifically, the data smoothening section 86 is composed of a moving average filter. At step S56, the data smoothening section 86 obtains the moving average of the music/talk determination results of the frames to smoothen them.

Figure 16:
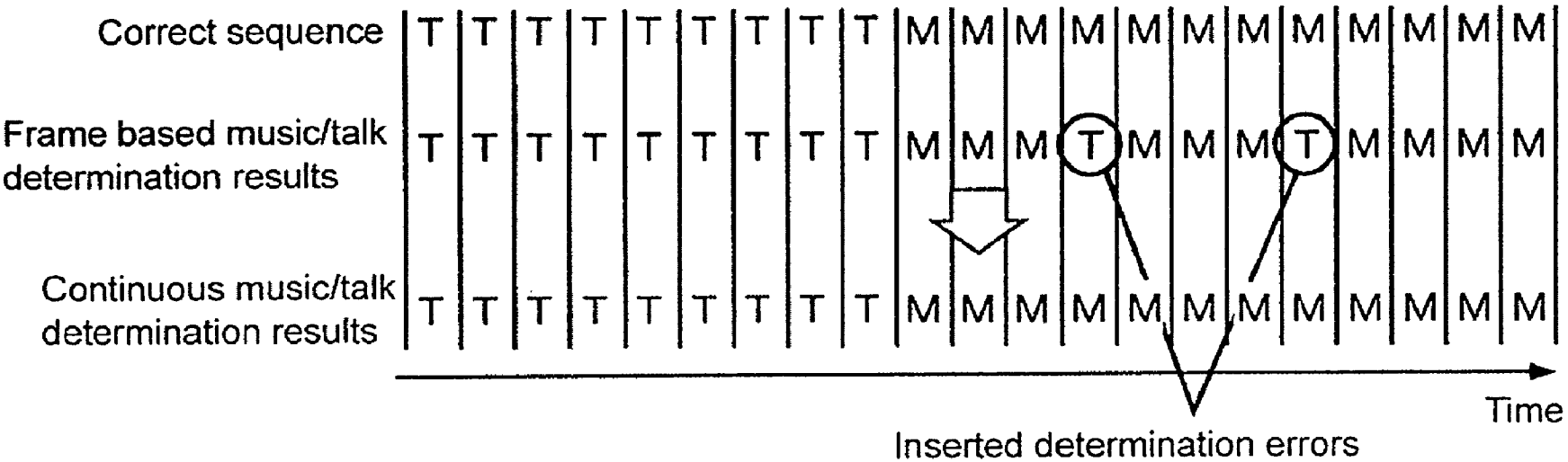
FIG. 16 is a schematic diagram describing that determination results of whether each frame is music or talk are smoothened.

In FIG. 16, the frame based music/talk determination results of 21 frames are talk (T), talk (T), talk (T), talk (T), talk (T), talk (T), talk (T), talk (T), talk (T), music (M), music (M), music (M), talk (T), music (M), music (M), music (M), talk (T), music (M), music (M), music (M), and music (M). Thus, the thirteenth frame and the seventeenth frame are talk (T), and the twelfth frame, fourteenth frame, sixteenth frame, and eighteenth frame are music (M). Next, this case will be described.

When the length of each frame is sufficiently decreased, a predetermined number of frames of talk continue or a predetermined number of frames of music continue. In other words, a frame of music is not preceded or followed by frames of talk. Likewise, a frame of talk is not preceded or followed by frames of music. Thus, 21 frames are arranged in the order of talk (T), talk (T), talk (T), talk (T), talk (T), talk (T), talk (T), talk (T), talk (T), music (M), music (M), music (M), music (M), music (M), music (M), music (M), music (M), music (M), music (M), music (M), music (M), music (M), music (M) as represented by the first sequence shown in FIG. 16. In other words, the frame based music/talk determination result represented by the second sequence shown in FIG. 16 contains determination errors of frames of talk at the thirteenth frame and the seventeenth frame.

The data smoothening section 86 obtains the moving average of the music/talk determination result of the frames to smoothen them. As a result, the data smoothening section 86 obtains continuous music/talk determination results of a 21-frame sequence of talk (T), talk (T), talk (T), talk (T), talk (T), talk (T), talk (T), talk (T), talk (T), music (M), music (M), music (M), talk (T), music (M), music (M), music (M), talk (T), music (M), music (M), music (M), and music (M) where the thirteenth frame and the seventeenth frame are music (M).

Thus, by smoothening the determination results, errors can be effectively filtered.

The data smoothening section 86 supplies the continuous music/talk determination results smoothened by obtaining the moving average of the frame based music/talk determination results to the sound storing section 87.

At step S57, the sound storing section 87 adds a label that identifies music or talk to each frame of sound data and stores the labeled sound data. Thereafter, the process is completed.

Figure 17:
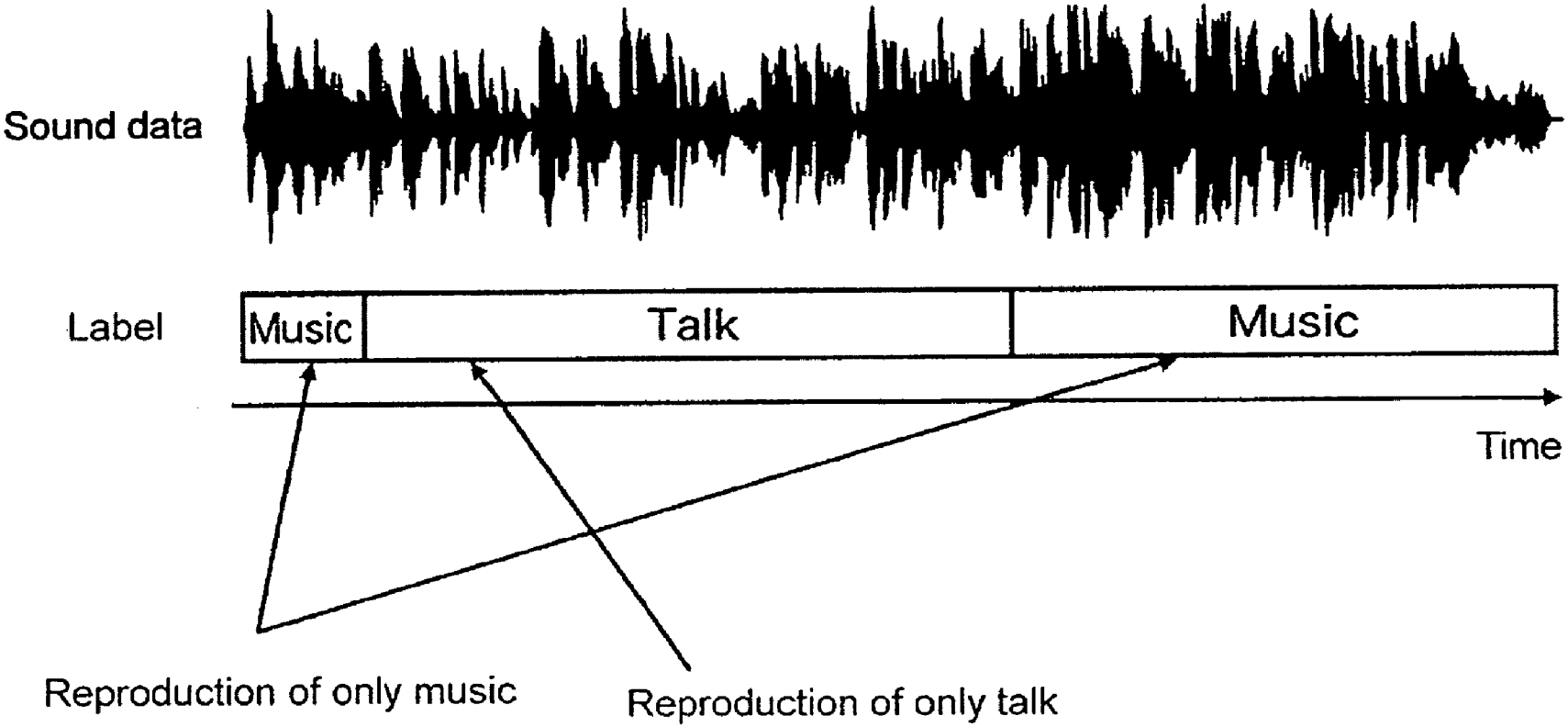
FIG. 17 is a schematic diagram showing exemplary sound data to which labels have been added.

For example, as shown in FIG. 17, the sound storing section 87 adds a label that identifies music or talk to each frame of the sound data. In other words, the sound storing section 87 adds a label that identifies music to a frame of sound data determined to be music as a continuous music/talk determination result and adds a label that identifies talk to a frame of sound data determined to be talk as a continuous music/talk determination result. The sound storing section 87 records and stores the sound data to which labels that identify music or talk have been added to a record medium such as a hard disk or an optical disc.

When music data to which labels that identify music or talk have been added are reproduced, with reference to the labels, only music regions or talk regions of the sound data can be reproduced. In contrast, when sound data to which labels that identify music or talk are reproduced, with reference to the labels, the sound data may be reproduced in such a manner that only music regions or talk regions are successively skipped from the sound data.

As described above, when a continuous characteristic quantity that is affected by past values of continuous data due to a time constant has been extracted, a target characteristic quantity taking into account of influence of past regions of continuous data against the current region can be obtained.

In the process of obtaining a target characteristic quantity, most of arithmetic operations are used to extract a continuous characteristic quantity. Thus, an increase of the time resolution corresponding to an increase of an overlap in a range of which a continuous characteristic quantity is cut does not largely increase the arithmetic operations of the process. In other words, the time resolution of a target characteristic quantity can be increased in a simpler structure than before without necessity of increasing the arithmetic operations in the process.

Continuous characteristic quantities can be extracted while continuous data are input. Thus, the latency after continuous data are input until a characteristic is obtained in this embodiment is smaller than that of the related art in which continuous data are divided into regions and characteristics are extracted therefrom.

Regardless of the case of which continuous data are divided into regions and characteristics are extracted therefrom according to the related art or the case of which a continuous characteristic quantity is extracted from continuous data, the extracted continuous characteristic quantity is divided into regions, and characteristics are obtained therefrom according to this embodiment of the present invention, the time lag (latency) after the continuous data are input until a characteristic quantity to be finally obtained is output is given by adding the period for which data for regions are input and the period for which the data are processed.

When continuous data are divided into regions and characteristics are extracted therefrom, the period for which data for regions are input is smaller than the period for which the data are processed.

In contrast, when a continuous characteristic quantity is extracted from continuous data, the continuous characteristic quantity is divided into regions, and characteristics are extracted therefrom, although the period for which data for the regions is nearly the same as the period in the case that continuous data are divided into regions and characteristics are extracted therefrom, the period for which the data are processed is small.

Thus, when a continuous characteristic quantity is extracted from continuous data, the extracted continuous characteristic quantity is divided into regions, and then characteristics are obtained therefrom, the time lag (latency) can become smaller than that in the case that continuous data are divided into regions and characteristics are extracted therefrom.

In addition, as the target characteristic quantity estimating section 34 or the music/talk determining section 85, a simple structure that obtains a target characteristic quantity that represents correct data from a regional characteristic quantity represented by a scalar or a vector can be used. Thus, the target characteristic quantity estimating section 34 or the music/talk determining section 85 can be created with one of various types of algorithms used in an ordinary machine learning process or statistical analyzing process without necessity of preparing a special model according to an objective problem.

In addition, a continuous characteristic quantity extraction algorithm that is used to extract a continuous characteristic quantity from continuous data and that is stored in the continuous characteristic quantity extracting section 31 shown in FIG. 1 or the time-musical interval analyzing section 81 and the continuous music characteristic quantity extracting section 82 shown in FIG. 9 may be automatically created by learning continuous data and teacher data composed of continuous data to which a label representing one correct characteristic has been added at each time (sample point).

Next, with reference to FIG. 18 to FIG. 25, a process of automatically creating a continuous characteristic quantity extraction algorithm will be described.

Figure 18:
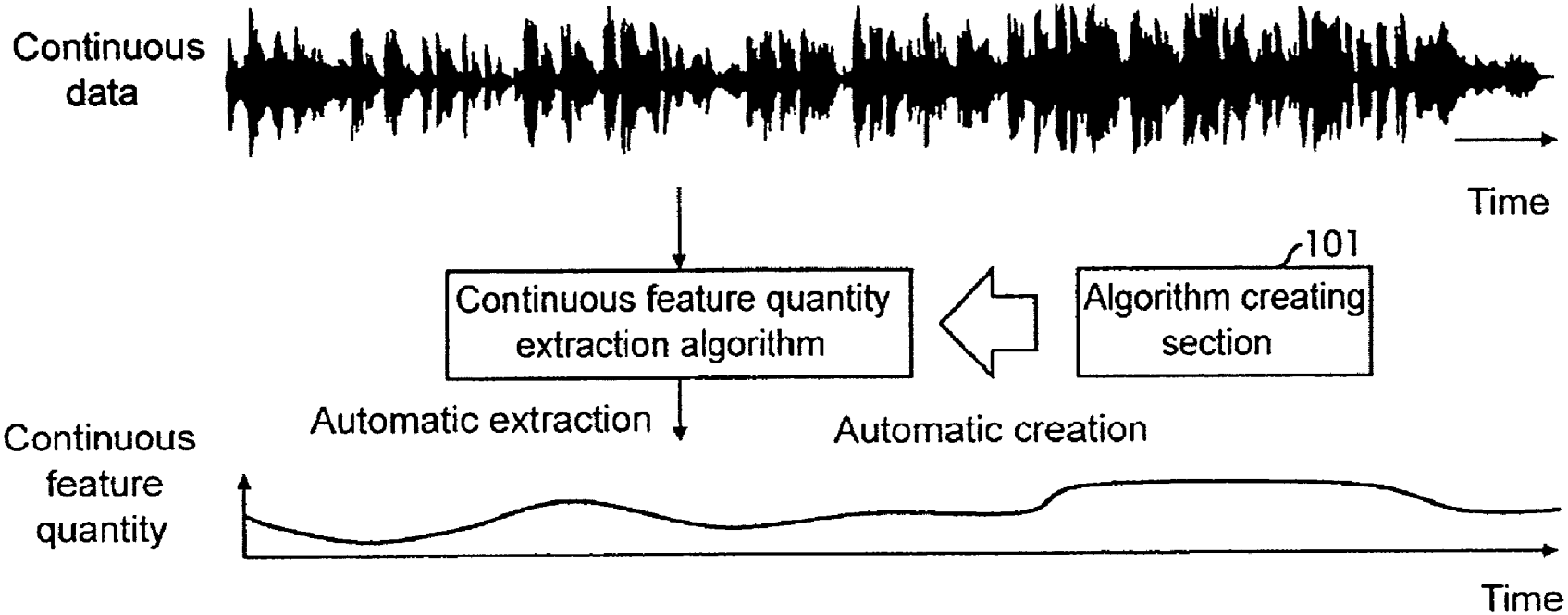
FIG. 18 is a schematic diagram describing an outline of a process of an algorithm creating section.

When a continuous characteristic quantity extraction algorithm is automatically created, an algorithm creating section 101 shown in FIG. 18 is newly disposed in the information processing apparatus 11 shown in FIG. 2 or the information processing apparatus 51 shown in FIG. 9. The algorithm creating section 101 automatically creates a continuous characteristic quantity extraction algorithm that automatically extracts a continuous characteristic quantity from continuous data that are input from the outside.

Figure 19:
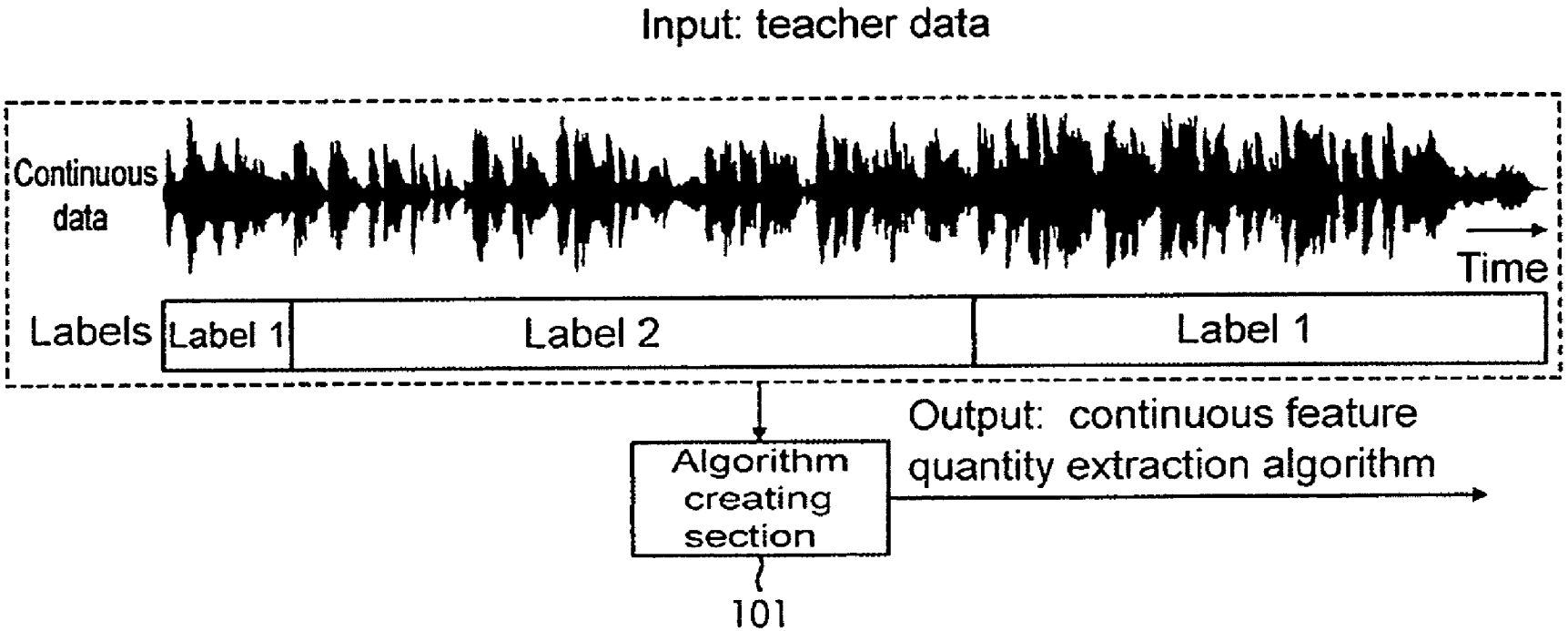
FIG. 19 is a schematic diagram describing an outline of a process of the algorithm creating section.

Specifically, as shown in FIG. 19, the algorithm creating section 101 performs a machine learning process according to GA (Genetic Algorithm) or GP (Genetic Programming) by inputting continuous data and teacher data composed of a label that represents one correct characteristic at each time of the continuous data, creates a continuous characteristic quantity extraction algorithm as a result of the machine learning process, and outputs the created continuous characteristic quantity extraction algorithm.

Figure 20:
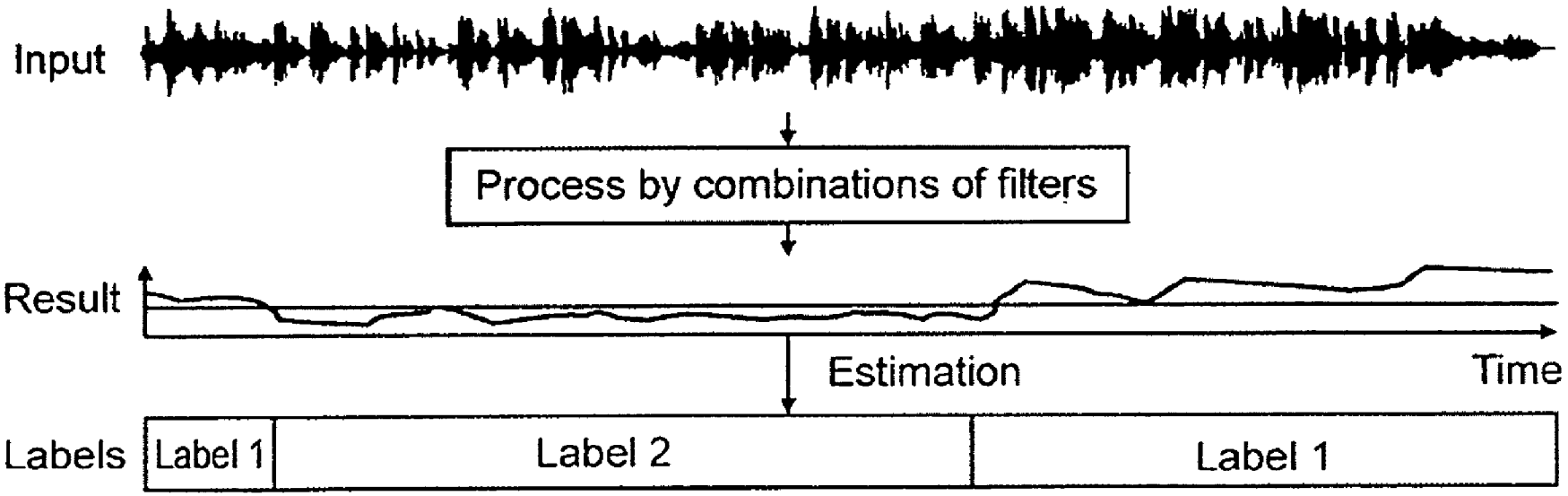
FIG. 20 is a schematic diagram describing an outline of a process of the algorithm creating section.

More specifically, as shown in FIG. 20, the algorithm creating section 101 creates various combinations of filters (functions), evaluates the accuracy level of a characteristic that each label represents in the continuous data according to a continuous characteristic quantity that is output as the result of the combinations of the created filters, and searches a combination of filters that outputs a continuous characteristic quantity with which a characteristic of the continuous data can be estimated with a higher accuracy from infinitive combinations of filters according to GA (Genetic Algorithm) or GP (Genetic Programming).

Figure 21:
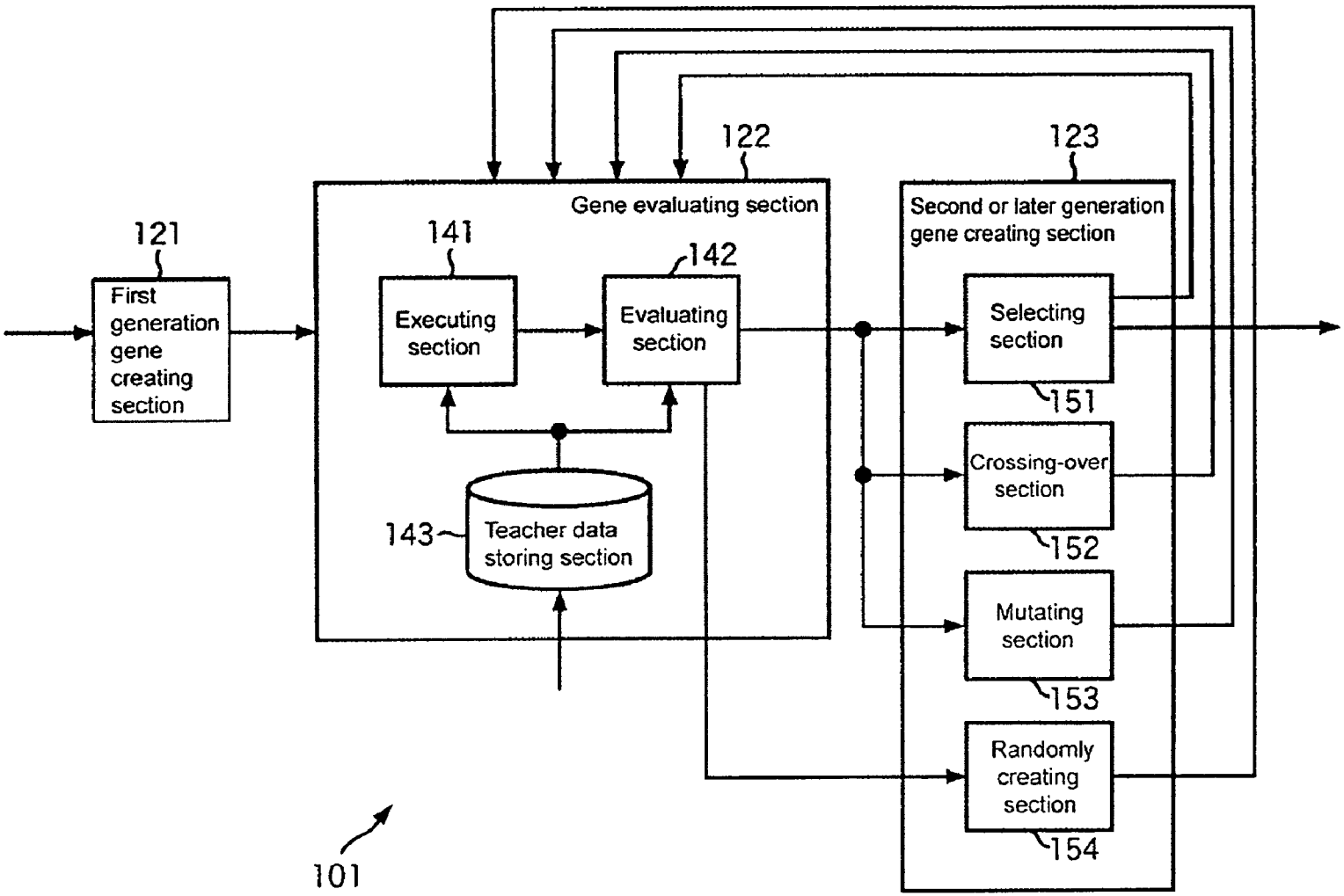
FIG. 21 is a block diagram showing a functional structure of the algorithm creating section.

FIG. 21 is a block diagram showing a functional structure of the algorithm creating section 101. The algorithm creating section 101 is composed of a first generation gene creating section 121, a gene evaluating section 122, and a second or later generation gene creating section 123.

The first generation gene creating section 121 creates first generation genes that represent various combinations of filters.

The gene evaluating section 122 evaluates the accuracy level in which a characteristic of continuous data represented by a label of teacher data can be estimated according to a continuous characteristic quantity extracted from the continuous data of the teacher data by a filter process represented by each gene created by the first generation gene creating section 121 or the second or later generation gene creating section 123. The gene evaluating section 122 is composed of an executing section 141, an evaluating section 142, and a teacher data storing section 143.

The executing section 141 inputs continuous data of teacher data stored in the teacher data storing section 143, successively executes filter processes represented by the individual genes, and extracts a continuous characteristic quantity of the input continuous data. The executing section 141 supplies the extracted continuous characteristic quantity to the evaluating section 142.

As will be described later with reference to FIG. 22, the evaluating section 142 calculates an evaluation value that represents the estimated accuracy level in which a characteristic of continuous data represented by a label of teacher data can be estimated according to a continuous characteristic quantity extracted from the continuous data of the teacher data by the executing section 141 for each gene created by the first generation gene creating section 121 or the second or later generation gene creating section 123. The evaluating section 142 supplies the evaluated genes and information that represents the evaluated values to a selecting section 151, a crossing-over section 152, and a mutating section 153 of the second or later generation gene creating section 123. In addition, the evaluating section 142 commands a randomly creating section 154 to create a predetermined number of genes. When the evaluating section 142 has determined that the evaluation values have become stable and the evolutions of genes have converged, the evaluating section 142 supplies these genes and their evaluation values to the selecting section 151.

The teacher data storing section 143 stores teacher data that are input from the outside.

The second or later generation gene creating section 123 creates genes of the second or later generations. As described above, the second or later generation gene creating section 123 is composed of the selecting section 151, the crossing-over section 152, the mutating section 153, and the randomly creating section 154.

As will be described later with reference to FIG. 22, the selecting section 151 selects genes that are caused to succeed from the current generation to the next generation according to the evaluation values obtained by the evaluating section 142 and supplies the selected genes as genes of the next generation to the gene evaluating section 122. When the selecting section 151 has determined that the evolutions of genes have converged, the selecting section 151 selects a predetermined number of genes from those having higher evaluation values and outputs combinations of filters represented by the selected genes as a continuous characteristic quantity extraction algorithm.

As will be described later with reference to FIG. 22, the crossing-over section 152 crosses over two genes by changing part of filters represented by two genes selected from those having higher evaluation values of the current generation. The crossing-over section 152 supplies the genes that have been crossed over as genes of the next generation to the gene evaluating section 122.

As will be described later with reference to FIG. 22, the mutating section 153 mutates a gene by randomly changing part of a filter of a gene randomly selected from those having higher evaluation values of the current generation. The mutating section 153 supplies the mutated gene as that of the next generation to the gene evaluating section 122.

As will be described later with reference to FIG. 22, the randomly creating section 154 creates new genes by randomly combining various types of filters. The randomly creating section 154 supplies the created genes as those of the next generation to the gene evaluating section 122.

Filters that compose genes created by the algorithm creating section 101 are time series data that are input in real time, namely filters used for continuous data. Examples of these filters include arithmetic operation filters (for four rule arithmetic operations, an exponential operation, a differentiation operation, an integration operation, and an absolute value operation), an LPF (Low Pass Filter), an HPF (High Pass Filter), a BPF (Band Pass Filter), an IIR (Infinite Impulse Response) filter, an FIR (Finite Impulse Response) filter, a real time level maximizer that equalizes the sound volume, a pitch tracer that traces a musical interval, and a level meter that creates an envelop of continuous data.

Genes are represented in the form of which filters are arranged in the order of which they are executed for example "pitch tracer→differentiation filter→absolute value filter (ABS)→LPF".

Figure 22:
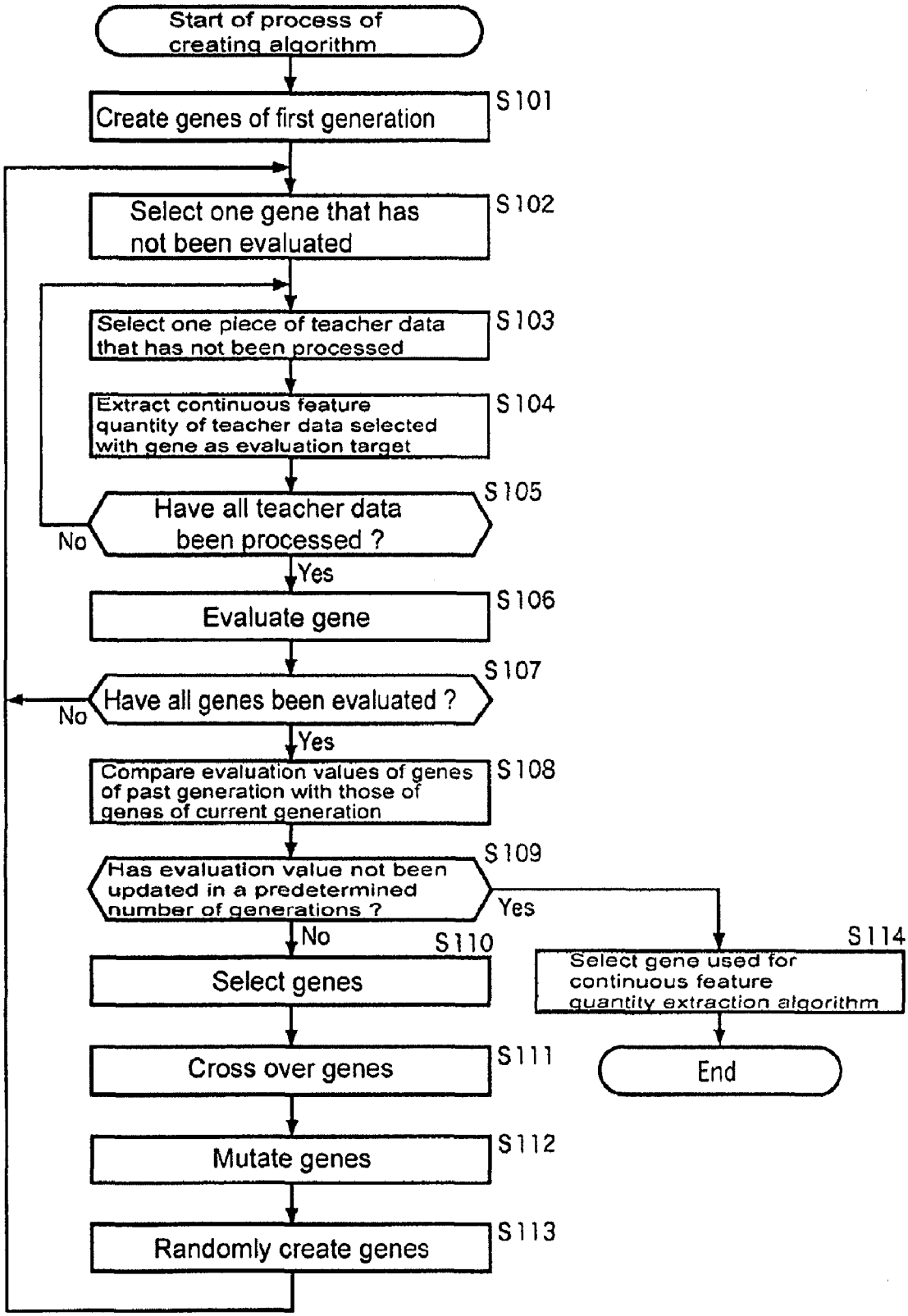
FIG. 22 is a flow chart describing an algorithm creating process.

FIG. 22 is a flow chart describing an algorithm creating process executed by the algorithm creating section 101.

Figure 23:
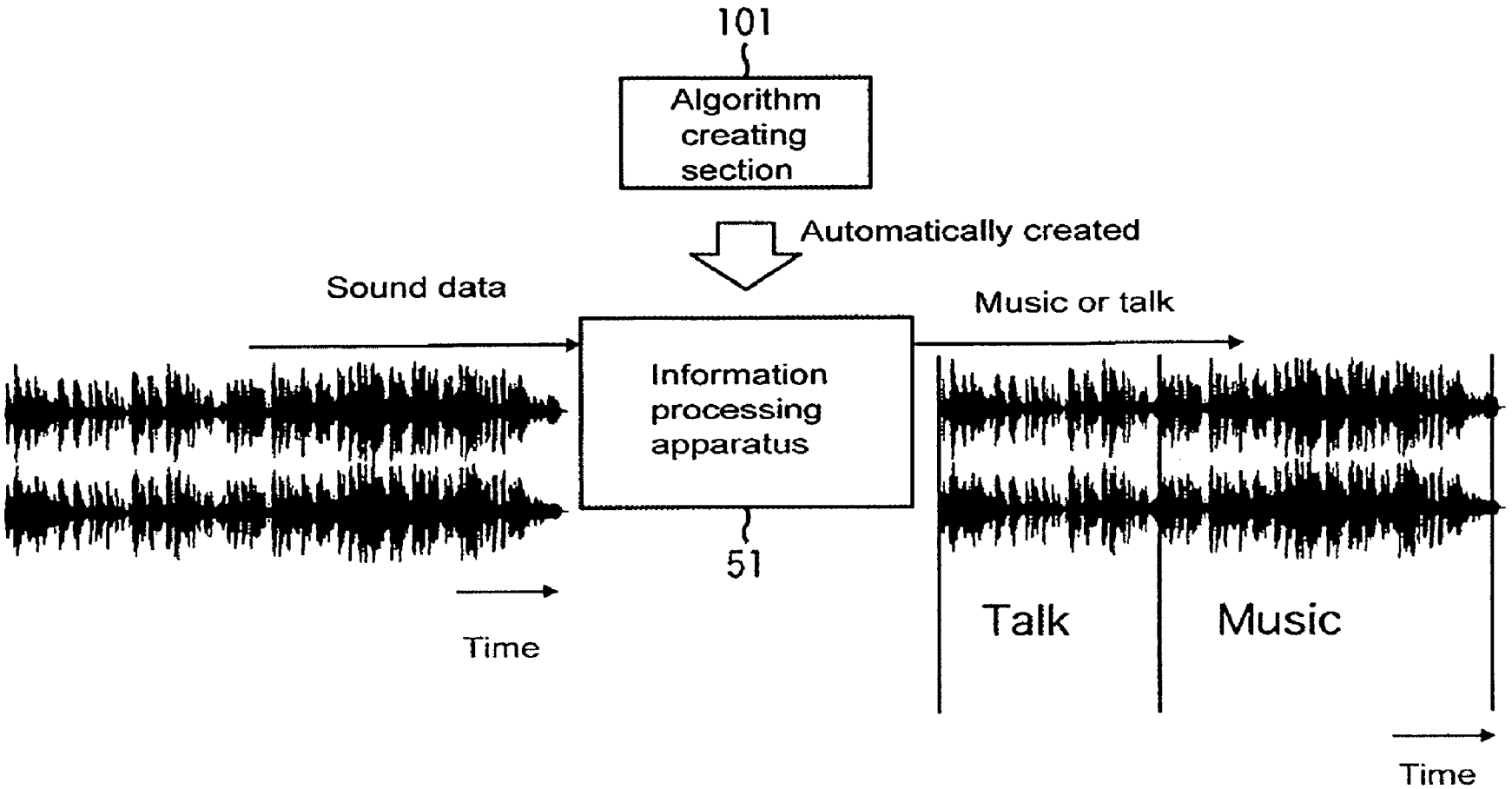
FIG. 23 is a schematic diagram describing an exemplary algorithm creating process.

Next, in the information processing apparatus 51 that determines whether input sound data are music or talk at each unit time described with reference to FIG. 9, a process of which the algorithm creating section 101 creates a continuous music characteristic quantity extraction algorithm that extracts a continuous music characteristic quantity from sound data will be exemplified as shown in FIG. 23. In other words, a process of which the algorithm creating section 101 creates a continuous characteristic quantity extraction algorithm corresponding to the time-musical interval analyzing section 81 and the continuous music characteristic quantity extracting section 82 shown in FIG. 9 will be exemplified.

At step S101, the first generation gene creating section 121 creates genes of the first generation. Specifically, the first generation gene creating section 121 creates a predetermined number of genes by randomly combining various types of filters used for time series data that are input in real time, namely continuous data. The first generation gene creating section 121 supplies the created genes to the gene evaluating section 122.

At step S102, the executing section 141 selects one gene that has not been evaluated from those supplied from the first generation gene creating section 121. In this case, the executing section 141 selects one gene that has not been evaluated as an evaluation target from those of the first generation created by the first generation gene creating section 121.

At step S103, the executing section 141 selects one piece of teacher data that have not been processed. Specifically, the executing section 141 selects one piece of teacher data that have not been processed by the gene as the current evaluation target from those stored in the teacher data storing section 143.

At step S104, the executing section 141 extracts a continuous characteristic quantity of the selected teacher data with the gene as the evaluation target. Specifically, the executing section 141 extracts a continuous characteristic quantity of the selected teacher data by inputting continuous data of the selected teacher data and successively executing the processes of the filters represented by the gene as the evaluation target.

Figure 24:
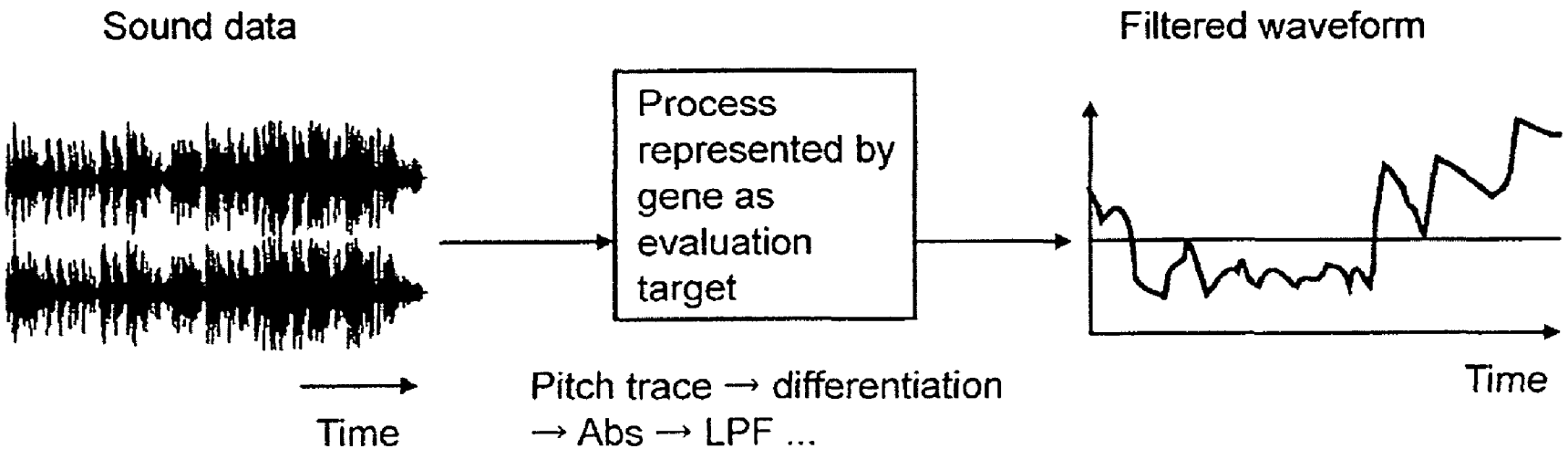
FIG. 24 is a schematic diagram describing that a process represented by a gene is executed.

When a continuous music characteristic quantity extraction algorithm is created, as shown in FIG. 24, a waveform of which sound data have been filtered is extracted as a continuous music characteristic quantity by performing processes represented by the gene as the evaluation target for sound data as teacher data, namely successively executing filter processes represented by the gene as the evaluation target.

The executing section 141 supplies the extracted continuous characteristic quantity to the evaluating section 142.

At step S105, the executing section 141 determines whether or not all the teacher data have been processed. When there are teacher data from which a continuous characteristic quantity has not been extracted for the gene as the evaluation target in those stored in the teacher data storing section 143, the executing section 141 determines that all the teacher data have not been processed. Thereafter, the flow returns to step S103. Thereafter, step S103 to step S105 are repeated until all the teacher data have been processed at step S105.

When the determination result at step S105 denotes that all the teacher data have been processed, the flow advances to step S106.

At step S106, the evaluating section 142 evaluates the gene.

Figure 25:
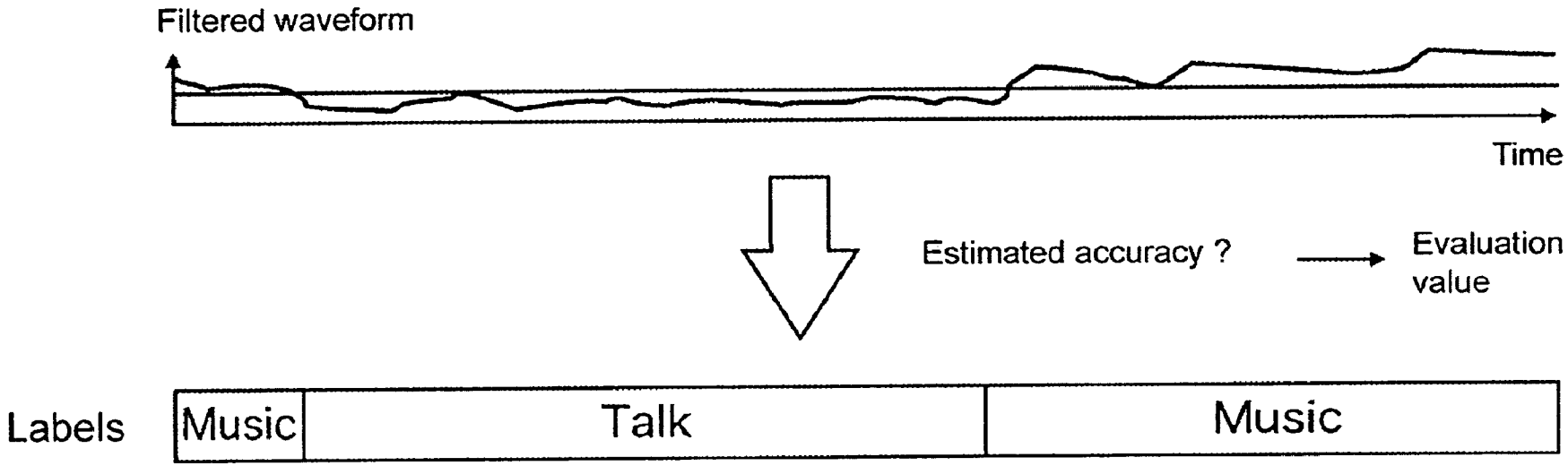
FIG. 25 is a schematic diagram describing that a gene is evaluated.

When a continuous music characteristic quantity extraction algorithm is created, as shown in FIG. 25, the evaluating section 142 calculates an evaluation value that represents the accuracy level of a characteristic quantity that represents a characteristic of continuous data represented by a label of teacher data, namely a characteristic quantity that represents music or talk as a target characteristic quantity of the information processing apparatus 51, from a filtered waveform that is a continuous music characteristic quantity extracted according to the gene as the evaluation target.

Next, a method of calculating an evaluation value will be exemplified.

When the values of labels of teacher data, namely characteristic quantities that represent a characteristic of continuous data, are represented by successive numerical values, for example, characteristic quantities represented in the correct data sequence are a sense of speed of a music represented by successive numerical values in the range from 0.0 to 1.0, for example the absolute values of Pearson's correlation coefficients are used as an evaluation value of the gene. Specifically, assuming that the values of labels of teacher data are represented by variable X and the values of corresponding continuous characteristic quantities are represented by variable Y, correlation coefficient r of variable X and variable Y is obtained by the following formula (1).

$r$=(covariance of variable $X$ and variable $Y$)/{(standard deviation of variable $X$)×(standard deviation of variable $Y$)}

$$r = \frac{\frac{1}{n-1}\sum_{i=1}^{n}(Xi-\overline{X})(Yi-\overline{Y})}{\sqrt{\frac{1}{n-1}\sum_{i=1}^{n}(Xi-\overline{X})^2}\sqrt{\frac{1}{n-1}\sum_{i=1}^{n}(Yi-\overline{Y})^2}} \quad (1)$$

where $\overline{X}$ is the average of X, $\overline{Y}$ is the average of Y.

The weaker the correlation of the values of continuous characteristic quantities extracted from continuous data and the values of characteristic quantities of continuous data represented by labels of teacher data, the more the correlation coefficient r has or approaches to 0. In contrast, the stronger the correlation, the more the correlation coefficient r has or approaches to 1.0 or −1.0. In other words, it is likely that the higher the accuracy of an estimated characteristic quantity of continuous data with continuous characteristic quantities extracted according to combinations of filters represented by a gene as an evaluation target, the more the correlation coefficient r approaches to 1.0 or −1.0, whereas the lower the accuracy, the more the correlation coefficient r approaches to 0.

When the value of a label of teacher data, namely a characteristic quantity that represents a characteristic of continuous data, is categorized as a predetermined class, as exemplified above a target characteristic quantity is categorized as talk or music or a vocal present state or a vocal absent state, then for example, Fisher's discriminant ratio (FDR) is used as an evaluation value.

For example, when a target characteristic quantity is categorized as two classes, in other words, a target characteristic quantity is represented as a binary value, the values of continuous characteristic quantities extracted in a process represented by a gene as a evaluation target are categorized as two sets according to the values of corresponding labels of teacher data and the sets are represented by set X and set Y, then the FDR is obtained by the following formula (2).

$$\text{FDR}=(\text{average of } X-\text{average of } Y)^2/\{(\text{standard deviation of } X+\text{standard deviation of } Y)\} \quad (2)$$

The weaker the correlation of the values of the continuous characteristic quantities extracted in a process represented by the gene as the evaluation target and the set to which the values belongs, namely the weaker the correlation of the values of the continuous characteristic quantities extracted in the process represented by the gene as the evaluation target and the characteristic quantities represented by the labels of teacher data is, the smaller the value of the FDR is. In contrast, the stronger the correlation of the values of the continuous characteristic quantities extracted in the process represented by the gene as the evaluation target and the set to which the values belong is, namely the stronger the correlation of the values of the continuous characteristic quantities extracted in the process represented by the gene as the evaluation target and the characteristic quantities represented by the labels of the teacher data is, the larger the value of the FDR is. In other words, it is likely that the larger the value of the FDR is, the higher the accuracy of the estimated characteristic quantity of the continuous data with the continuous characteristic quantities extracted according to combinations of filters represented by the gene as the evaluation target is, whereas the smaller the value of the FDR is, the lower the accuracy is.

The foregoing method of calculating the evaluation value of a gene is exemplary. Rather, it is preferred to use a proper method with a continuous characteristic quantity extracted in a process represented by a gene and a characteristic quantity represented by a label of teacher data.

When the number of calculations increases because there are many samples of a continuous characteristic quantity, if necessary, the number of samples of the continuous characteristic quantity may be decimated.

At step S107, the evaluating section 142 determines whether all genes have been evaluated. When the determination result at step S107 denotes that all the genes have not been evaluated, the flow returns to step S102. Step S102 to step S107 are repeated until the determination result at step S107 denotes that all the genes have been evaluated.

When the determination result at step S107 denotes that all the genes have been evaluated, in this case, all the genes of the first generation have been evaluated, the flow advances to step S108.

At step S108, the evaluating section 142 compares the evaluation values of the genes of the past generations with those of the genes of the current generation. In this case, since the genes of the first generation are being evaluated and the evaluation values of the genes of the past generations have not been stored, the evaluating section 142 stores the maximum value of the evaluation values of the genes of the first generation as the evaluation value of the current gene.

At step S109, the evaluating section 142 determines whether or not the evaluation values have been updated in predetermined generations. In this case, since the evaluation values have been changed at step S108, the flow advances to step S110.

At step S110, the selecting section 151 selects genes. Specifically, the evaluating section 142 supplies all genes of the current generation and information that represents the evaluation values of the genes to the selecting section 151. The selecting section 151 selects a predetermined number of the genes from those having higher evaluation values and supplies the selected genes as those of the next generation to the gene evaluating section 122.

At step S111, the crossing-over section 152 crosses over genes. Specifically, the evaluating section 142 supplies all the genes of the current generation and information that represents the evaluation values of the genes to the crossing-over section 152. The crossing-over section 152 randomly selects two genes from those having higher evaluation values than a predetermine value and crosses over filters between the selected genes. Thus, the crossing-over section 152 crosses over the two genes by recombining filters represented by the genes. The crossing-over section 152 crosses over a predetermined number of genes and supplies the genes that have been crossed over as those of the next generation to the gene evaluating section 122.

At step S112, the mutating section 153 mutates genes. Specifically, the evaluating section 142 supplies all genes of the current generation and information that represents the evaluation values of the genes to the mutating section 153. The mutating section 153 mutates the genes by randomly selecting a predetermined number of genes from those having higher evaluation values than a predetermined value and randomly changing part of filters of the selected genes. The mutating section 153 supplies the mutated genes as genes of the next generation to the gene evaluating section 122.

At step S113, the randomly creating section 154 randomly creates genes. Specifically, the evaluating section 142 commands the randomly creating section 154 to create a predetermined number of genes. The randomly creating section 154 randomly creates a predetermined number of genes in the same process as does the first generation gene creating section 121. The randomly creating section 154 supplies the created genes as genes of the next generation to the gene evaluating section 122.

Thereafter, the flow returns to step S102. Step S102 to step S107 are repeated until it has been determined that all genes of the second generation have been evaluated at step S107.

When the determined result at step S107 denotes that all the genes have been evaluated, namely all the genes of the second generation have been evaluated, the flow advances to step S108.

At step S108, in this case, the evaluating section 142 compares the evaluation values of the genes of the immediately preceding generation that have been stored, namely the evaluation values of the genes of the first generation, with the maximum value of the evaluation values of the genes of the second generation. When the maximum value of the evaluation values of the genes of the second generation is larger than the evaluation values of the genes of the first generation, the evaluating section 142 updates the evaluation value of the current gene with the maximum value of the evaluation values of the genes of the second generation. When the maximum value of the evaluation values of the genes of the second generation is equal to or smaller than the evaluation values of the genes of the first generation, the evaluating section 142 does not update the evaluation value of the current gene with the maximum value of the evaluation value of the second generation and uses the evaluation value of the current gene.

Step S102 to step S113 are repeated until it has been determined at step S109 that the evaluation value has not been updated in a predetermined number of generations. In other words, genes of new generations are created and evaluated, evaluation values of genes of an immediately preceding generation and the maximum value of evaluation values of genes of a new generation are compared, and the evaluation values of the genes of the current generation are updated when the maximum value of the evaluation values of the genes of the new generation is larger than the evaluation values of the genes of the immediately preceding generation until the evaluation values of genes have not been updated in a predetermined number of generations.

When the determination result at step S109 denotes that the evaluation values of genes have not been updated in the predetermined number of generations, namely the evaluation values of genes are stable and the evolutions of the genes have converged, the flow advances to step S114.

Instead, at step S109, it may be determined whether or not the maximum value of the evaluation values of genes of the current generation is equal to or larger than a predetermined threshold value. In this case, when the determination result at step S109 denotes that the maximum value of the evaluation values of the genes of the current generation is smaller than the predetermined threshold value, namely the accuracy of a characteristic quantity estimated with combinations of filters represented by the genes of the current generation does not satisfy a desired value, the flow advances to step S110. In contrast, when the determination result at step S109 denotes that the maximum value of the evaluation values of the genes of the current generation is equal to or larger than the predetermined threshold value, namely the accuracy of a characteristic quantity estimated with combinations of filters represented by the genes of the current generation satisfies a desired value, the flow advances to step S114.

At step S114, the selecting section 151 selects a gene used for the continuous characteristic quantity extraction algorithm. Thereafter, the algorithm creating process is completed. Specifically, the evaluating section 142 supplies all the genes of the current generation and the evaluation values of the genes to the selecting section 151. The selecting section 151 selects a predetermined number of genes (at least one) having the highest evaluation value from all the genes of the current generation and outputs combinations of filters represented by the selected genes as a continuous characteristic quantity extraction algorithm.

Instead, at step S114, all genes having evaluation values higher than a predetermined threshold value may be selected from all the genes of the current generation and combinations of filters represented by the selected genes may be output as a continuous characteristic quantity extraction algorithm.

In such a manner, a continuous characteristic quantity extraction algorithm that is used in the information processing apparatus 11 shown in FIG. 2 or the information processing apparatus 51 shown in FIG. 9 and that extracts a continuous characteristic quantity from continuous data is created.

Since the continuous characteristic quantity extraction algorithm is automatically created according to GA or GP, combinations of filters that extract continuous characteristic quantities that are more suitable to estimate a target characteristic quantity can be obtained from much more combinations of filters than an algorithm that is manually created. Thus, it can be expected to improve the estimation accuracy for a target characteristic quantity.

In the information processing apparatus 11 shown in FIG. 2 or the information processing apparatus 51 shown in FIG. 9, a continuous characteristic quantity extraction algorithm that extracts continuous characteristic quantities may be created only by the algorithm creating section 101. Instead, a continuous characteristic quantity extraction algorithm may be manually created. Instead, both a continuous characteristic quantity extraction algorithm that is created by the algorithm creating section 101 and a continuous characteristic quantity extraction algorithm that is manually created may be used in parallel.

In the foregoing description, the information processing apparatus that processes continuous data such as sound data or moving image data was exemplified. However, as embodiments, the present invention may be applied to a recording/reproducing apparatus that records and reproduces sound data or moving image data, an recording apparatus that records sound data or moving image data, a reproducing apparatus that reproduces sound data or moving image data, and so forth. More specifically, as embodiments, the present invention may be applied to a record player having a built-in optical disc drive or hard disk, a portable recorder or player, a digital video camera, a mobile phone, and so forth having a built-in semiconductor memory.

In the foregoing description, a target characteristic quantity represents a characteristic to be finally obtained that is for example music or talk. Instead, a target characteristic quantity may be a value representing a probability of a characteristic to be finally obtained such as a probability of music or talk.

When a target characteristic quantity extraction formula is created by a learning process and arithmetic operations are performed according to the target characteristic quantity extraction formula, then a characteristic of data can be extracted. When chronologically continuous sound data are chronologically continuously analyzed in each of predetermined frequency bands, a continuous characteristic quantity is extracted as a chronologically continuous characteristic quantity from the analysis result, the continuous characteristic quantity is cut into regions each of which has a predetermined length, a regional characteristic quantity that is a characteristic quantity represented by one scalar or vector is extracted from each region, and a target characteristic quantity that is a characteristic quantity that represents one characteristic of sound data is estimated from the regional characteristic quantity, then a characteristic of the sound data can be easily and quickly extracted.

The foregoing sequence of processes may be executed by hardware or software. When the sequence of processes is executed by software, programs that compose the software are built in dedicated hardware of a computer or installed from a program record medium to for example a general purpose personal computer that executes various types of functions according to various programs installed thereto.

Figure 26:
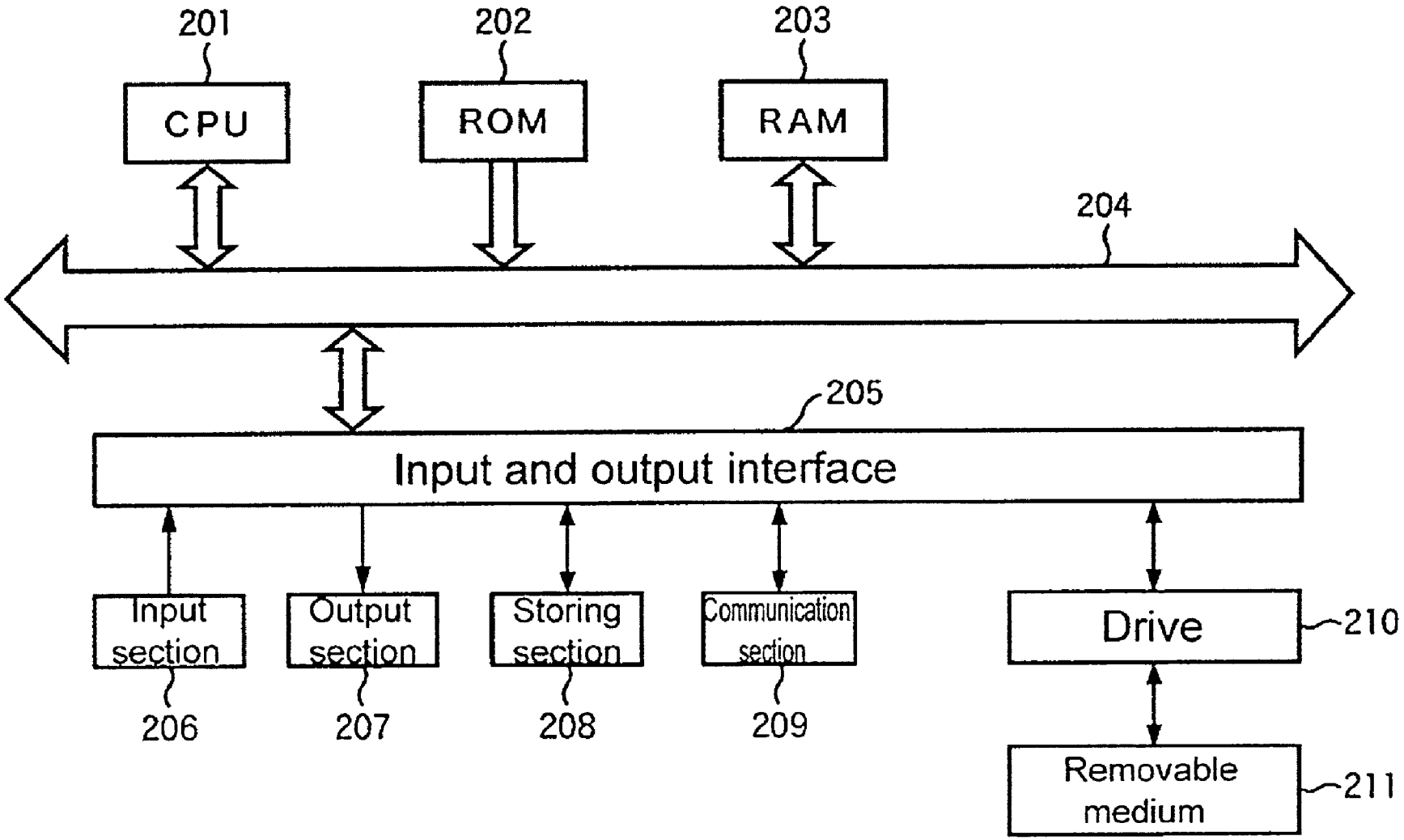
FIG. 26 is a block diagram showing an exemplary structure of a personal computer.

FIG. 26 is a block diagram showing an exemplary structure of a personal computer that executes the foregoing sequence of processes according to the programs. A CPU (Central Processing Unit) 201 executes various types of processes according to programs stored in a ROM (Read Only Memory) 202 or a storing section 208. When necessary, a RAM (Random Access Memory) 203 stores programs, data and so forth, which cause the CPU 201 to execute processes. The CPU 201, the ROM 202, and the RAM 203 are connected to each other by a bus 204.

Connected to the CPU 201 through the bus 204 is also an input and output interface 205. Connected to the input and output interface 205 are an input section 206 composed of a keyboard, a mouse, a microphone, and so forth and an output section 207 composed of a display, a speaker, and so forth. The CPU 201 executes various types of processes according to commands that are input from the input section 206. The CPU 201 outputs the results of the processes to the output section 207.

A storing section 208 connected to the input and output interface 205 is composed of for example a hard disk. The storing section 208 stores programs and various types of data that cause the CPU 201 to execute processes. A communication section 209 communicates with an external device through a network such as the Internet or a local area network.

Instead, programs may be obtained through the communication section 209 and stored in the storing section 208.

When a removable medium 211 such as a magnetic disc, an optical disc, a magneto-optical disc, a semiconductor memory, or the like is attached to a drive 210 connected to the input and output interface 205, the drive 210 causes the removable medium 211 to read and obtain programs, data, and so forth therefrom. When necessary, the obtained programs and data are transferred to the storing section 208 and stored therein.

As shown in FIG. 26, a program record medium that stores programs installed to and executed by the computer is composed of the removable medium 211 that is a package medium such as a magnetic disc (including a flexible disc), an optical disc (including a CD-ROM (Compact Disc-Read Only Memory), a DVD (Digital Versatile Disc), a magneto-optical disc), or a semiconductor memory), the ROM 202 that temporarily or permanently stores programs, or the hard disk that composes the storing section 208. When necessary, programs are stored to the program record medium through the communication section 209 that is an interface such as a router or a modem or through a wired or wireless communication medium such as a local area network, the Internet, or a digital satellite broadcast.

In this specification, steps that describe a program stored in the program record medium are chronologically processed in the order of which they are described. Instead, these steps may be executed in parallel or discretely.

It should be understood by those skilled in the art that various modifications, combinations, sub-combinations and alternations may occur depending on design requirements and other factors insofar as they are within the scope of the appended claims or the equivalents thereof.

What is claimed is:

1. An information processing apparatus, comprising:

analyzing means for chronologically continuously analyzing sound data which chronologically continue in each of predetermined frequency bands;

continuous characteristic quantity extracting means for extracting a continuous characteristic quantity which is a characteristic quantity which chronologically continues from an analysis result of the analyzing means;

cutting means for cutting the continuous characteristic quantity into regions each of which has a predetermined length;

regional characteristic quantity extracting means for extracting a regional characteristic quantity which is a characteristic quantity represented by one scalar or vector from each of the regions into which the continuous characteristic quantity has been cut; and target characteristic quantity estimating means for estimating a target characteristic quantity which is a characteristic quantity which represents one characteristic of the sound data from each of the regional characteristic quantities, wherein the target characteristic quantity estimating means is pre-created by learning teacher data composed of sound data which chronologically continue and a characteristic quantity which represents one correct characteristic of sound data in each of the regions into which the continuous characteristic quantity has been cut.

2. The information processing apparatus as set forth in claim 1, wherein the analyzing means chronologically continuously analyzes the sound data which chronologically continue as sounds of musical intervals of 12 equal temperaments of each octave, and wherein the continuous characteristic quantity extracting means extracts the continuous characteristic quantity from data which have been obtained as an analysis result of the analyzing means and which represent energies of the musical intervals of the 12 equal temperaments of each octave.

3. The information processing apparatus as set forth in claim 1, wherein the target characteristic quantity estimating means estimates the target characteristic quantity which identifies music or talk as a characteristic of the sound data.

4. The information processing apparatus as set forth in claim 1, further comprising:

smoothening means for smoothening the target characteristic quantities by obtaining a moving average thereof.

5. The information processing apparatus as set forth in claim 1, further comprising:

storing means for adding a label which identifies a characteristic represented by the estimated target characteristic quantity to the sound data and storing the sound data to which the label has been added.

6. The information processing apparatus as set forth in claim 1, further comprising:

algorithm creating means for creating an algorithm which extracts the continuous characteristic quantity from the sound data which chronologically continue according to GA (Genetic Algorithm) or GP (Genetic Programming).

7. An information processing method, implemented by a computer, comprising the steps of:

chronologically continuously analyzing, by the computer, sound data which chronologically continue in each of predetermined frequency bands;

extracting, by the computer, a continuous characteristic quantity which is a characteristic quantity which chronologically continues from an analysis result at the analyzing step;

cutting, by the computer, the continuous characteristic quantity into regions each of which has a predetermined length;

extracting, by the computer, a regional characteristic quantity which is a characteristic quantity represented by one scalar or vector from each of the regions into which the continuous characteristic quantity has been cut; and estimating, by the computer, a target characteristic quantity which is a characteristic quantity which represents one characteristic of the sound data from each of the regional characteristic quantities, wherein the estimating includes a pre-creating step by learning teacher data composed of sound data which chronologically continue and a characteristic quantity which represents one correct characteristic of sound data in each of the regions into which the continuous characteristic quantity has been cut.

8. A non-transitory computer-readable medium encoded with a program which is executed by a computer, the program comprising the steps of:

chronologically continuously analyzing sound data which chronologically continue in each of predetermined frequency bands;

extracting a continuous characteristic quantity which is a characteristic quantity which chronologically continues from an analysis result at the analyzing step;

cutting the continuous characteristic quantity into regions each of which has a predetermined length;

extracting a regional characteristic quantity which is a characteristic quantity represented by one scalar or vector from each of the regions into which the continuous characteristic quantity has been cut; and estimating a target characteristic quantity which is a characteristic quantity which represents one characteristic of the sound data from each of the regional characteristic quantities, wherein the estimating includes a pre-creating step by learning teacher data composed of sound data which chronologically continue and a characteristic quantity which represents one correct characteristic of sound data in each of the regions into which the continuous characteristic quantity has been cut.

9. A non-transitory record medium on which a program which is executed by a computer has been recorded, the program comprising the steps of:

chronologically continuously analyzing sound data which chronologically continue in each of predetermined frequency bands;

extracting a continuous characteristic quantity which is a characteristic quantity which chronologically continues from an analysis result at the analyzing step;

cutting the continuous characteristic quantity into regions each of which has a predetermined length;

extracting a regional characteristic quantity which is a characteristic quantity represented by one scalar or vector from each of the regions into which the continuous characteristic quantity has been cut; and estimating a target characteristic quantity which is a characteristic quantity which represents one characteristic of the sound data from each of the regional characteristic quantities, wherein the estimating includes a pre-creating step by learning teacher data composed of sound data which chronologically continue and a characteristic quantity which represents one correct characteristic of sound data in each of the regions into which the continuous characteristic quantity has been cut.

10. An information processing apparatus, comprising:

an analyzing section which chronologically continuously analyzes sound data which chronologically continue in each of predetermined frequency bands;

a continuous characteristic quantity extracting section which extracts a continuous characteristic quantity which is a characteristic quantity which chronologically continues from an analysis result of the analyzing section;

a cutting section which cuts the continuous characteristic quantity into regions each of which has a predetermined length;

a regional characteristic quantity extracting section which extracts a regional characteristic quantity which is a characteristic quantity represented by one scalar or vector from each of the regions into which the continuous characteristic quantity has been cut; and a target characteristic quantity estimating section which estimates a target characteristic quantity which is a characteristic quantity which represents one characteristic of the sound data from each of the regional characteristic quantities, wherein the target characteristic quantity estimating section is pre-created by learning teacher data composed of sound data which chronologically continue and a characteristic quantity which represents one correct characteristic of sound data in each of the regions into which the continuous characteristic quantity has been cut.

* * * * *